US007084861B2

(12) United States Patent
Iisaka

(10) Patent No.: US 7,084,861 B2
(45) Date of Patent: Aug. 1, 2006

(54) SYSTEM AND METHODS FOR DRIVING AN ELECTROOPTIC DEVICE

(75) Inventor: Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 260 days.

(21) Appl. No.: 10/062,441

(22) Filed: Feb. 5, 2002

(65) Prior Publication Data

US 2002/0158857 A1 Oct. 31, 2002

(30) Foreign Application Priority Data

Jul. 3, 2001 (JP) ..... 2001-202131
Aug. 1, 2001 (JP) ..... 2001-233539
Nov. 30, 2001 (JP) ..... 2001-367074

(51) Int. Cl.
*G09G 5/00* (2006.01)

(52) U.S. Cl. ..... 345/204; 345/89

(58) Field of Classification Search ..... 345/87–90, 345/690–693
See application file for complete search history.

(56) References Cited

U.S. PATENT DOCUMENTS 5,596,344 A * 1/1997 Kuwata et al. ..... 345/89
5,712,652 A * 1/1998 Sato et al. ..... 345/90
5,912,651 A * 6/1999 Bitzakidis et al. ..... 345/58
6,037,920 A * 3/2000 Mizutome et al. ..... 345/87
6,057,809 A * 5/2000 Singhal et al. ..... 345/87
6,151,004 A 11/2000 Kancko
6,914,656 B1 * 7/2005 Sakamoto et al. ..... 349/141
2002/0036611 A1 * 3/2002 Ishii ..... 345/89
2003/0137499 A1 * 7/2003 Iisaka ..... 345/204
2003/0142055 A1 * 7/2003 Iisaka ..... 345/89

FOREIGN PATENT DOCUMENTS

WO WO 01/24155 A1 5/2001

* cited by examiner

*Primary Examiner*—Amare Mengistu
(74) *Attorney, Agent, or Firm*—Oliff & Berridge, PLC

(57) ABSTRACT

The invention provides a system and methods for driving an electrooptic device where one field is divided into a plurality of subfields on a time base, thereby to set the subfields as control units for driving a pixel. A liquid crystal that exhibits such a low response rate that the saturation response time thereof is longer than one subfield period. Accordingly, even when an ON voltage is applied to the liquid crystal in only one predetermined subfield by way of example, the transmission factor of the liquid crystal does not reach 100%. That is, the change of the transmission factor in each subfield can be finely controlled in the transitional period of the transmission factor of the liquid crystal. Accordingly, the number of gradations can be remarkably enlarged as compared with the number of the subfields within one field, and displays at multiple gradations can be accomplished.

6 Claims, 22 Drawing Sheets

H : WRITING PIXEL DATA
L : WITHOUT WRITING PIXEL DATA
Sf1~Sf255 : SUBFIELDS
1f : FIELD $f_i$ (i=1~7) : FIELD
PA, PB : PULSE WIDTH
D1, D2 : GRADATION $f_i$ (i=1~7) : FIELD
D1, D2 : GRADATION

SYSTEM AND METHODS FOR DRIVING AN ELECTROOPTIC DEVICE

BACKGROUND OF THE INVENTION

1. Field of Invention

The present invention relates to a driving method and a drive circuit for an electrooptic device in which a gradational display control is performed by a subfield drive scheme, as well as to an electrooptic device, and electronic equipment.

2. Description of Related Art

Currently, electrooptic devices, such as, liquid-crystal display devices each employing a liquid crystal as an electrooptic material, are extensively used in the display portions of various information processing equipment, liquid-crystal television sets, etc. as display devices which replace cathode ray tubes (CRTs). Such electrooptic devices can be constructed of an element substrate which is provided with pixel electrodes arrayed in the shape of a matrix, switching elements, such as TFTs (Thin Film Transistors), connected to the pixel electrodes, etc., an opposing substrate which is formed with a counter electrode opposing to the pixel electrodes, and a liquid crystal being an electrooptic material which is packed between both the substrates. A display mode of the electrooptic device in such a construction includes "normally white" being a mode which presents a white display in a state where a voltage is not applied (OFF state), and "normally black" being a mode which presents a black display in the state. Now, the operation of presenting a gradational display in the case where the display mode of the electrooptic device is the normally-black mode will be explained.

In the above construction, when a scanning signal is applied to each switching element through a scanning line, the pertinent switching element falls into a conductive state. When, under the conductive state, a picture signal of a voltage corresponding to a gradation is applied to each pixel electrode through a data line, charges corresponding to the voltage of the picture signal are stored in the pertinent pixel electrode and counter electrode. Even when the pertinent switching element is brought into an OFF state after the storage of the charges, the charges in the pertinent electrodes are kept stored by the capacitativeness of the liquid crystal layer itself, a storage capacitance, etc. When, in this manner, each switching element is driven, and the quantity of charges to be stored is controlled in correspondence with the gradation, the oriented state of the liquid crystal varies with every pixel, and hence, the density varies with every pixel. It is therefore possible to present the gradational display.

Additionally, in a case where the display mode of the electrooptic device is the normally-white mode, a similar effect is obtained in such a way that the state of the voltage is changed from the OFF state into an ON state in the above operation.

In the above operation, it may be in a partial period of time that the charges are stored in the liquid crystal layer of each pixel, so the following controls are possible:

(1) Sequentially selecting the individual scanning lines by a scanning line drive circuit (2) Supplying picture signals to the data lines by a data line drive circuit in the period of the selection of the scanning line; and (3) Sampling picture signals from the data lines.

Owing to the controls (1), (2) and (3), time-division multiplexing drive is realized in which the scanning line and the data line are respectively made common to pluralities of pixels.

However, the picture signals which are applied to the data lines are voltages corresponding to gradations, namely, analog signals. Therefore, D/A conversion circuits, operational amplifiers etc. are required as the peripheral circuits of the electrooptic device, thus incurring a high cost for the whole device. In addition, nonuniformity in display appears due to discrepancies in the characteristics of the D/A conversion circuits, the operational amplifiers etc. and in various wiring resistances etc., resulting in the problem that a display of high quality is very difficult to obtain. This problem becomes more apparent in the case of presenting a display of high definition.

SUMMARY OF THE INVENTION

In order to solve the above problems, therefore, a subfield drive scheme wherein one field is divided into a plurality of subfields on a time base and wherein an ON voltage or OFF voltage is applied to each pixel in correspondence with a gradation in each of the subfields has been proposed as a digital drive scheme for driving a liquid crystal in an electrooptic device, for example, a liquid crystal device.

With the subfield drive scheme, the voltage to be applied to the liquid crystal is not changed by a voltage level, but the voltage to be impressed on the liquid crystal (effective voltage) is changed by the application time period of a voltage pulse, thereby controlling the transmission factor of a liquid crystal panel. Voltage levels which are necessary for the drive of the liquid crystal are only the two levels of an ON level and an OFF level.

Meanwhile, in a case where a dynamic picture image is displayed in a liquid-crystal display device being an electrooptic device, an improvement in the response characteristic of a liquid crystal is indispensable for enhancing the reproducibility of the dynamic picture image. The response characteristic of the liquid crystal is such that the response rate heightens in accordance with the magnitude of an electric field applied to a liquid crystal layer at a constant temperature and as to the transition of the liquid crystal from the steady state (oriented state) thereof.

Besides, a predetermined response time is required for the transition of the liquid crystal into the oriented state from a state where the electric field is applied to the liquid crystal layer. In general, the response time is several times as long as the time period for which the electric field was applied to the liquid crystal layer.

Further, in a case where the liquid crystal in the liquid crystal device being the electrooptic device is caused to present a gradational display by the subfield drive, the response characteristic changes due to the change of the temperature of the liquid crystal itself or the ambient temperature of the liquid crystal. This poses the problem that the gradation characteristic of the liquid crystal changes depending upon the manner of the temporal arrangement of a pulse for an ON state and a pulse for an OFF state, so the picture quality degrades.

Moreover, the subfield drive scheme being simple has had the problem that displayable gradations are limited by the number of divisional subfields. By way of example, in a case where one field is divided into M subfields, the number of displayable gradations becomes (M+1). The number of subfields must be enlarged in order to increase the number of gradations, but in that case, the screen needs to be scanned at high speed. In actuality, however, the scanning speed is limited by the operating speed of the driving element.

The present invention has been made in view of such circumstances, and it is an object of the invention to provide a driving method and a drive circuit for an electrooptic device, and an electrooptic device, in which enhancement in picture quality can be achieved by betterment of the response characteristic of a liquid crystal being an electrooptic material, and in which even in the case of determining subfields by simple field division without weighting, gradations can be displayed in a much larger number than the number of the subfields, and further, an electronic equipment which employs the electrooptic device.

A drive circuit of an electrooptic device relating to the present invention supplies a display portion wherein pixels are constructed in a matrix shape out of an electrooptic material whose transmission factor for light is variable by application of a voltage, with an ON voltage capable of saturating the transmission factor or an OFF voltage capable of bringing the electrooptic material into a non-transmissive state, thereby to implement subfield drive in which a gradation is expressed in accordance with states of a light transmissive state and the non-transmissive state of the electrooptic material in a unit time, and a time ratio of the states. The invention can include a drive device for setting as control units a plurality of subfields into which a field period is divided on a time base. The drive device can also set a time period of each of the subfields to be shorter than a saturation response time which is required for saturating the transmission factor of the electrooptic material in the case of applying the ON voltage, and determine on the basis of display data the subfields to apply the ON voltage therein and the subfields to apply the OFF voltage therein, thereby to express the gradation.

According to such a construction, the electrooptic material constituting each pixel can have its light transmission factor varied by the application of the voltage. The drive device sets as the control units the plurality of subfields into which the field period is divided on the time base, and it applies to the electrooptic material the ON voltage capable of saturating the transmission factor or the OFF voltage capable of bringing the electrooptic material into the non-transmissive state, thereby to subject each pixel to the subfield drive. The drive device can set the time period of each subfield to be shorter than the saturation response time which is required for saturating the transmission factor of the electrooptic material in the case of applying the ON voltage, and it determines on the basis of the display data the subfields to apply the ON voltage therein and the subfields to apply the OFF voltage therein, thereby to express the gradation. Since the saturation response time of the electrooptic material is longer than the time period of one subfield, the transmission factor thereof can be changed more finely relative to the number of the subfields within one field. Thus, the number of expressible gradations can be remarkably enlarged as compared with the number of the subfields within one field.

Besides, a drive circuit of an electrooptic device relating to the present invention supplies a display portion wherein pixels are constructed in a matrix shape out of an electrooptic material whose transmission factor for light is variable by application of a voltage, with an ON voltage capable of saturating the transmission factor or an OFF voltage capable of bringing the electrooptic material into a non-transmissive state, thereby to implement subfield drive in which a gradation is expressed in accordance with states of a light transmissive state and the non-transmissive state of the electrooptic material in a unit time, and a time ratio of the states. The invention can include a drive device for setting as control units a plurality of subfields into which a field period is divided on a time base. The drive device also sets a time period of each of the subfields to be shorter than a non-transmission response time which is required for shifting the transmission factor of the electrooptic material from a saturated state into the non-transmissive state in the case of applying the OFF voltage, and determines on the basis of display data the subfields to apply the ON voltage therein and the subfields to apply the OFF voltage therein, thereby to express the gradation.

According to such a construction, the drive device sets the time period of each subfield to be shorter than the non-transmission response time which is required for shifting the transmission factor of the electrooptic material from the saturated state into the non-transmissive state in the case of applying the OFF voltage, and it determines on the basis of the display data the subfields to apply the ON voltage therein and the subfields to apply the OFF voltage therein, thereby to express the gradation. Since the non-transmission response time of the electrooptic material is longer than the time period of one subfield, the transmission factor thereof can be changed more finely relative to the number of the subfields within one field. Thus, the number of expressible gradations can be remarkably enlarged as compared with the number of the subfields within one field.

The drive device of the drive circuit can apply the ON voltage to the electrooptic material in successive or non-successive subfields so that an integral value of the transmissive state of the electrooptic material in the pertinent field period may correspond to the display data. According to such a construction, the ON voltage is applied to the electrooptic material in the successive or non-successive subfields so that the integral value of the transmissive state of the electrooptic material in the field period may correspond to the display data. Thus, displays at multiple gradations can be realized.

Besides, the drive circuit is characterized in that the plurality of subfields within each field are set at substantially the same time width.

Owing to such a construction, the drive circuit can be simplified, and it is applicable to the subfield drive of a display device which employs the electrooptic material, such as a liquid crystal, having a predetermined response time.

The drive circuit is characterized in that the saturation response time is a time period which is not shorter than three subfield periods. Owing to such a construction, the change of the transmission factor of the electrooptic material per subfield period is comparatively small, and hence, displays at more gradations can be realized.

The drive circuit is characterized in that the non-transmission response time is a time period which is not shorter than three subfield periods. Owing to such a construction, the change of the transmission factor of the electrooptic material per subfield period is comparatively small, and hence, displays at more gradations can be realized.

The drive circuit is characterized in that the ON voltage is applied to the electrooptic material in concentrated fashion in subfield periods on the lead side of the field period. Owing to such a construction, the electrooptic material is easily brought into the non-transmissive state at the tail of the field period, so that the display response characteristic can be enhanced.

The drive circuit is characterized in that the OFF voltage is applied to the electrooptic material in concentrated fashion in subfield periods on the end side of the field period. Owing to such a construction, the electrooptic material is easily brought into the non-transmissive state at the end of the field period, so that a display response characteristic can be enhanced.

A drive method of an electrooptic device relating to the present invention is a drive method of an electrooptic device that supplies a display portion wherein pixels are constructed in a matrix shape out of an electrooptic material whose transmission factor for light is variable by application of a voltage, with an ON voltage capable of saturating the transmission factor or an OFF voltage capable of bringing the electrooptic material into a non-transmissive state, thereby to implement subfield drive in which a gradation is expressed in accordance with states of a light transmissive state and the non-transmissive state of the electrooptic material in a unit time, and a time ratio of the states. The method can include setting as control units a plurality of subfields into which a field period is divided on a time base, setting a time period of each of the subfields to be shorter than a saturation response time which is required for saturating the transmission factor of the electrooptic material in the case of applying the ON voltage, and determining on the basis of display data the subfields to apply the ON voltage therein and the subfields to apply the OFF voltage therein, thereby to express the gradation.

According to such a construction, the electrooptic material constituting each pixel can have its light transmission factor varied by the application of voltage. In the subfield drive, each pixel is driven by setting as the control units the plurality of subfields into which the field period is divided on the time base, and applying to the electrooptic material the ON voltage capable of saturating the transmission factor or the OFF voltage capable of bringing the electrooptic material into the non-transmissive state. The time period of each subfield is set to be shorter than the saturation response time which is required for saturating the transmission factor of the electrooptic material in the case of applying the ON voltage, and the gradation is expressed by determining on the basis of the display data the subfields to apply the ON voltage therein and the subfields to apply the OFF voltage therein. Since the saturation response time of the electrooptic material is longer than the time period of one subfield, the transmission factor thereof can be changed more finely relative to the number of the subfields within one field. Thus, the number of expressible gradations can be remarkably enlarged as compared with the number of the subfields within one field.

Besides, a drive method of an electrooptic device relating to the present invention is a drive method of an electrooptic device that supplies a display portion wherein pixels are constructed in a matrix shape out of an electrooptic material whose transmission factor for light is variable by application of a voltage, with an ON voltage capable of saturating the transmission factor or an OFF voltage capable of bringing the electrooptic material into a non-transmissive state, thereby to implement subfield drive in which a gradation is expressed in accordance with states of a light transmissive state and the non-transmissive state of the electrooptic material in a unit time, and in accordance with a time ratio of the states. The method can include setting as control units a plurality of subfields into which a field period is divided on a time base, setting a time period of each of the subfields to be shorter than a non-transmission response time which is required for shifting the transmission factor of the electrooptic material from a saturated state into the non-transmissive state in the case of applying the OFF voltage, and determining on the basis of display data the subfields to apply the ON voltage therein and the subfields to apply the OFF voltage therein, thereby to express the gradation.

According to such a construction, the time period of each subfield is set to be shorter than the non-transmission response time which is required for shifting the transmission factor of the electrooptic material from the saturated state into the non-transmissive state in the case of applying the OFF voltage, and the gradation is expressed by determining on the basis of the display data the subfields to apply the ON voltage therein and the subfields to apply the OFF voltage therein. Since the non-transmission response time of the electrooptic material is longer than the time period of one subfield, the transmission factor thereof can be changed more finely relative to the number of the subfields within one field. Thus, the number of expressible gradations can be remarkably enlarged as compared with the number of the subfields within one field.

The drive method is characterized in that the gradation is expressed by applying the ON voltage to the electrooptic material in successive or non-successive subfields so that an integral value of the transmissive state of the electrooptic material in the pertinent field period may correspond to the display data. According to such a construction, the ON voltage is applied to the electrooptic material in the successive or non-successive subfields so that the integral value of the transmissive state of the electrooptic material in the field period may correspond to the display data. Thus, displays at multiple gradations can be realized.

Besides, a drive method of an electrooptic device relating to the present invention is a drive method of an electrooptic device that divides each field into a plurality of subfields on a time base, and controls and drives a plurality of pixels which include an electrooptic material enclosed in intersection areas between a plurality of data lines and a plurality of scanning lines, by an ON voltage or an OFF voltage every subfield in accordance with display data, whereby the respective pixels display gradations within one field. The method can include setting a time period of each of the subfields to be shorter than a saturation response time which is required for saturating the transmission factor of the electrooptic material in the case of applying the ON voltage, and determining on the basis of the display data the subfields to apply the ON voltage therein and the subfields to apply the OFF voltage therein.

According to such a construction, the time period of each subfield is set to be shorter than the saturation response time which is required for saturating the transmission factor of the electrooptic material in the case of applying the ON voltage. Thus, the change of the transmission factor of the electrooptic material in one subfield period is small, and displays at multiple gradations can be realized.

An electrooptic device relating to the present invention can include the drive circuit of an electrooptic device as defined above. According to such a construction, the transmission factor can be finely controlled in the subfield drive, and displays at multiple gradations can be realized.

Besides, an electrooptic device relating to the present invention has pixels which include pixel electrodes disposed in correspondence with intersections between a plurality of scanning lines and a plurality of data lines, switching elements for controlling voltages to be applied to the respective pixel electrodes, an electrooptic material enclosed in intersection areas between the plurality of data lines and the plurality of scanning lines, and a counter electrode arranged in opposition to the pixel electrodes, and implements subfield drive in which, by supplying an ON voltage capable of saturating a transmission factor of the electrooptic material or an OFF voltage capable of bringing the electrooptic material into a non-transmissive state, a gradation is displayed in accordance with states of a light transmissive state and the non-transmissive state of the electrooptic material in a unit time, and a time ratio of the states. The present invention can include a drive device for setting as control units a plurality of subfields into which a field period is divided on a time base, setting a time period of each of the subfields to be shorter than a saturation response time which is required for saturating the transmission factor of the electrooptic material in the case of applying the ON voltage, and determining on the basis of display data the subfields to apply the ON voltage therein and the subfields to apply the OFF voltage therein, thereby to express the gradation.

According to such a construction, the pixels include the pixel electrodes, switching elements, electrooptic material and counter electrode, and multi-gradational displays can be realized in application to, for example, a liquid crystal device.

An electronic equipment relating to the present invention is an electronic equipment including the above electrooptic device. According to such a construction, multi-gradational displays can be realized.

Besides, the present invention can include a drive method of an electrooptic device that divides each field into a plurality of subfields on a time base, and drives a plurality of pixels which include an electrooptic material enclosed in intersection areas between a plurality of data lines and a plurality of scanning lines, by an ON voltage or an OFF voltage in each of the subfields in accordance with gradation data, whereby the respective pixels are brought into transmissive states or non-transmissive states so as to display gradations within one field by employing a subfield drive scheme. The method can include performing control so that pulse signals for bringing the respective pixels into the transmissive states may be concentrated in the first half of the pertinent field.

According to such a construction, the plurality of pixels which include the pixel electrodes disposed in correspondence with the intersections between the plurality of data lines and the plurality of scanning lines, and the electrooptic material enclosed in the intersection areas between the plurality of data lines and the plurality of scanning lines, are driven by the ON voltage or the OFF voltage in accordance with the gradation data, whereby the respective pixels are brought into the transmissive states or the non-transmissive states so as to display the gradations. In this case, each field is divided into the plurality of subfields on the time base, the respective pixels are driven by the ON voltage or the OFF voltage in accordance with the gradation data in each of the subfields, and control is performed so that the pulse signals for bringing the respective pixels into the transmissive states may be concentrated in the first half of the pertinent field.

Thus, a time period in which a liquid crystal as the electrooptic material constituting the pixels reaches a target transmission factor can be shortened to heighten the response rate, with the result that enhancement in picture quality is achieved.

Besides, the present invention can include a drive method of an electrooptic device that divides each field into a plurality of subfields on a time base, and drives a plurality of pixels which include an electrooptic material enclosed in intersection areas between a plurality of data lines and a plurality of scanning lines, by an ON voltage or an OFF voltage in each of the subfields in accordance with gradation data, whereby the respective pixels are brought into transmissive states or non-transmissive states so as to display gradations within one field by a subfield drive scheme. The method can include in a case where display content changes at changeover of fields in displaying a dynamic picture image, the pulse width of the pulse signals for bringing the pixels into the transmissive states in a later field is altered in accordance with the direction in which the displayed gradations change.

According to the present invention, pixels which include pixel electrodes disposed in correspondence with intersections between a plurality of scanning lines and a plurality of data lines, switching elements for controlling voltages to be applied to the respective pixel electrodes, a liquid crystal enclosed in intersection areas between the plurality of data lines and the plurality of scanning lines, and a counter electrode arranged in opposition to the pixel electrodes, are driven by an ON voltage or an OFF voltage so as to be respectively brought into transmissive states or non-transmissive states in each of the subfields in accordance with gradation data, whereby the pixels display gradations. Herein, each field is divided into the plurality of subfields on a time base, the respective pixels are driven by the ON voltage or the OFF voltage in accordance with the gradation data in each subfield, and in a case where display content changes at changeover of fields in displaying a dynamic picture image, the pulse width of the pulse signals for bringing the pixels into the transmissive states in a later field is altered in accordance with the direction in which the displayed gradations change.

Thus, in the case where the display content changes at the changeover of the fields in displaying the dynamic picture image, the response characteristic of the liquid crystal as an electrooptic material constituting the pixels can be bettered so that desired gradations may be quickly attained in the direction in which displayed gradations change, and enhancement in picture quality is achieved.

Besides, the present invention can include a drive method of an electrooptic device that divides each field into a plurality of subfields on a time base, and drives a plurality of pixels which include an electrooptic material enclosed in intersection areas between a plurality of data lines and a plurality of scanning lines, by an ON voltage or an OFF voltage in each of the subfields in accordance with gradation data, whereby the respective pixels are brought into transmissive states or non-transmissive states so as to display gradations within one field by a subfield drive scheme. The method can include using pulse signals for bringing the respective pixels into the non-transmissive states are outputted in, at least, the last of the subfields of the pertinent field.

According to the present invention, pixels which include pixel electrodes disposed in correspondence with intersections between a plurality of scanning lines and a plurality of data lines, switching elements for controlling voltages to be applied to the respective pixel electrodes, a liquid crystal enclosed in intersection areas between the plurality of data lines and the plurality of scanning lines, and a counter electrode arranged in opposition to the pixel electrodes, are driven by an ON voltage or an OFF voltage so as to be respectively brought into transmissive states or non-transmissive states in accordance with gradation data, whereby the pixels display gradations. Herein, each field is divided into the plurality of subfields on a time base, the respective pixels are driven by the ON voltage or the OFF voltage in accordance with the gradation data in each subfield, and at the changeover of fields in displaying a dynamic picture image, the pulse signals for bringing the pixels into the non-transmissive states are outputted in, at least, the last subfield of the earlier field.

Thus, a black display of short time can be inserted before displaying the next field, and the adjacent fields are not continuously displayed, but are intermittently displayed, so that the recognizability of the dynamic picture image is enhanced.

Besides, the present invention can include a drive method of an electrooptic device that divides each field into a plurality of subfields on a time base, and drives a plurality of pixels which include an electrooptic material enclosed in intersection areas between a plurality of data lines and a plurality of scanning lines, by an ON voltage or an OFF voltage in each of the subfields in accordance with gradation data, whereby the respective pixels are brought into transmissive states or non-transmissive states so as to display gradations within one field by employing a subfield drive scheme. The method can include that the pulse width of the pulse signals for bringing the pixels into the transmissive states is altered in each field in accordance with the temperature of the electrooptic material itself or the ambient temperature of the electrooptic material.

According to the present invention, pixels which include pixel electrodes disposed in correspondence with intersections between a plurality of scanning lines and a plurality of data lines, switching elements for controlling voltages to be applied to the respective pixel electrodes, a liquid crystal enclosed in intersection areas between the plurality of data lines and the plurality of scanning lines, and a counter electrode arranged in opposition to the pixel electrodes, are driven by an ON voltage or an OFF voltage so as to be respectively brought into transmissive states or non-transmissive states in each subfield in accordance with gradation data, whereby the pixels display gradations. Herein, each field is divided into the plurality of subfields on a time base, the respective pixels are driven by the ON voltage or the OFF voltage in accordance with the gradation data in each subfield, and control is performed so that the pulse width of the pulse signals for bringing the pixels into the transmissive states may be altered in each field in accordance with the temperature of the electrooptic material itself or the ambient temperature of the electrooptic material. Thus, even when the response rate of the liquid crystal being the electrooptic material changes depending upon the temperature of the liquid crystal or the ambient temperature of the liquid crystal, the gradation characteristic can be held constant, and the deterioration of the gradation characteristic attributed to the temperature change can be relieved, so that enhancement in picture quality is achieved.

Besides, the present invention can include a drive circuit of an electrooptic device having pixels which include pixel electrodes disposed in correspondence with intersections between a plurality of scanning lines and a plurality of data lines, switching elements for controlling voltages to be applied to the respective pixel electrodes, an electrooptic material enclosed in intersection areas between the plurality of data lines and the plurality of scanning lines, and a counter electrode arranged in opposition to the pixel electrodes. The drive circuit divides each field into a plurality of subfields on a time base, and drives the pixels by an ON voltage or an OFF voltage in each of the subfields in accordance with gradation data, whereby the respective pixels are brought into transmissive states or non-transmissive states so as to display gradations within one field by employing a subfield drive scheme. The invention can include a control device for performing control so that pulse signals for bringing the respective pixels into the transmissive states may be concentrated in the first half of the pertinent field.

Besides, in one aspect of the present invention, the drive circuit is characterized in that, in a case where display content changes at changeover of fields in displaying a dynamic picture image, the control device alters the pulse width of the pulse signals for bringing the pixels into the transmissive states in a later field in accordance with the direction in which the brightness of the screen changes.

According to the present invention, the pixels which include the pixel electrodes disposed in correspondence with the intersections between the plurality of scanning lines and the plurality of data lines, the switching elements for controlling voltages to be applied to the respective pixel electrodes, a liquid crystal enclosed in the intersection areas between the plurality of data lines and the plurality of scanning lines, and the counter electrode arranged in opposition to the pixel electrodes, are driven by the ON voltage or the OFF voltage so as to be respectively brought into the transmissive states or the non-transmissive states in accordance with the gradation data, whereby the pixels display the gradations. Herein, each field is divided into the plurality of subfields on the time base, the respective pixels are driven by the ON voltage or the OFF voltage in accordance with the gradation data in each subfield, and control is performed by the control device so that the pulse signals for bringing the respective pixels into the transmissive states may be concentrated in the first half of each field.

Thus, a time period in which the liquid crystal as the electrooptic material constituting the pixels reaches a target transmission factor can be shortened to heighten the response rate, with the result that enhancement in picture quality is achieved.

Besides, in the case where the display content changes at the changeover of fields in displaying the dynamic picture image, the control device performs control so as to alter the pulse width of the pulse signals for bringing the pixels into the transmissive states in the later field in accordance with the direction in which the brightness of the screen changes.

Thus, in the case where the display content changes at the changeover of the fields in displaying the dynamic picture image, the response characteristic of the liquid crystal as the electrooptic material constituting the pixels can be bettered so that desired gradations may be quickly attained in the direction in which screen brightness changes, and enhancement in picture quality is achieved.

Besides, in another aspect of the present invention, the drive circuit is characterized in that the control device outputs pulse signals for bringing the respective pixels into the non-transmissive states, in, at least, the last of the subfields of the pertinent field. Thus, a black display of short time can be inserted before displaying the next field, and the adjacent fields are not continuously displayed, but are intermittently displayed, so that the recognizability of the dynamic picture image is enhanced.

Besides, the present invention can include a drive circuit of an electrooptic device having pixels which include pixel electrodes disposed in correspondence with intersections between a plurality of scanning lines and a plurality of data lines, switching elements for controlling voltages to be applied to the respective pixel electrodes, an electrooptic material enclosed in intersection areas between the plurality of data lines and the plurality of scanning lines, and a counter electrode arranged in opposition to the pixel electrodes. The drive circuit divides each field into a plurality of subfields on a time base, and drives the pixels by an ON voltage or an OFF voltage in each of the subfields in accordance with gradation data, whereby the respective pixels are brought into transmissive states or non-transmissive states so as to display gradations within one field by employing a subfield drive scheme. The invention can further include a temperature detection device for detecting the temperature of the electrooptic material itself or the ambient temperature of the electrooptic material, and a pulse width correction device for making corrections so that the pulse width of the pulse signals for bringing the pixels into the transmissive states as is predetermined in correspondence with each gradation may be altered on the basis of a detection output of the temperature detection means in each field.

According to the present invention, the pixels which include the pixel electrodes disposed in correspondence with the intersections between the plurality of scanning lines and the plurality of data lines, the switching elements for controlling voltages to be applied to the respective pixel electrodes, a liquid crystal enclosed in the intersection areas between the plurality of data lines and the plurality of scanning lines, and the counter electrode arranged in opposition to the pixel electrodes, are driven by the ON voltage or the OFF voltage so as to be respectively brought into the transmissive states or the non-transmissive states in each subfield in accordance with the gradation data, whereby the pixels display the gradations. Herein, each field is divided into the plurality of subfields on the time base, and the respective pixels are driven by the ON voltage or the OFF voltage in accordance with the gradation data in each subfield. In addition, the temperature of the electrooptic material itself or the ambient temperature of the electrooptic material is detected by the temperature detection device, and the pulse width of the pulse signals for bringing the pixels into the transmissive states as is predetermined in correspondence with each gradation is altered on the basis of the detection output of the temperature detection device in each field by the control device.

Thus, even when the response rate of the liquid crystal being the electrooptic material changes depending upon the temperature of the liquid crystal or the ambient temperature of the liquid crystal, a gradation characteristic can be held constant, and the deterioration of the gradation characteristic attributed to the temperature change can be relieved, so that enhancement in picture quality is achieved.

Besides, an electrooptic device relating to the present invention is can include pixels which include pixel electrodes disposed in correspondence with intersections between a plurality of scanning lines and a plurality of data lines, switching elements for controlling voltages to be applied to the respective pixel electrodes, an electrooptic material enclosed in intersection areas between the plurality of data lines and the plurality of scanning lines, and a counter electrode arranged in opposition to the pixel electrodes. The device can further include a scanning line drive circuit which supplies scanning signals for dividing each field into a plurality of subfields on a time base, and for rendering the switching elements conductive in each of the plurality of subfields, to the scanning lines, a data line drive circuit which supplies binary signals for designating an ON voltage or an OFF voltage and thus bringing the pixels into transmissive states or non-transmissive states on the basis of gradation data, to the data lines corresponding to the pertinent pixels, the binary signals being supplied in time periods in which the scanning signals are respectively supplied to the scanning lines corresponding to the pertinent pixels, and a control device for controlling the data line drive circuit so that pulse signals for bringing the respective pixels into the transmissive states may be concentrated in the first half of each field.

Besides, in one aspect of the present invention, the electrooptic device is characterized in that, in a case where display content changes at changeover of fields in displaying a dynamic picture image, the control device alters the pulse width of the pulse signals for bringing the pixels into the transmissive states in a later field in accordance with the direction in which the brightness of the screen changes.

According to the present invention, the scanning signals for dividing each field into the plurality of subfields on the time base, and for rendering the switching elements conductive in each of the plurality of subfields, are supplied to the scanning lines by the scanning line drive circuit, and the binary signals for designating the ON voltage or the OFF voltage and thus bringing the pixels into the transmissive states or the non-transmissive states on the basis of the gradation data in each of the subfields, are supplied to the data lines correspondent to the pertinent pixels by the data line drive circuit in the time periods in which the scanning signals are respectively supplied to the scanning lines correspondent to the pertinent pixels, whereby the respective pixels present gradational displays. Herein, the data line drive circuit is controlled by the control device so that the pulse signals for bringing the respective pixels into the transmissive states may be concentrated in the first half of each field.

Thus, a time period in which a liquid crystal as the electrooptic material constituting the pixels reaches a target transmission factor can be shortened to heighten the response rate, with the result that enhancement in picture quality is achieved.

Besides, in the case where the display content changes at the changeover of fields in displaying the dynamic picture image, the control device performs control so as to alter the pulse width of the pulse signals for bringing the pixels into the transmissive states in the later field in accordance with the direction in which the brightness of the screen changes.

Thus, in the case where the display content changes at the changeover of the fields in displaying the dynamic picture image, the response characteristic of the liquid crystal as the electrooptic material constituting the pixels can be bettered so that desired gradations may be quickly attained in the direction in which screen brightness changes, and enhancement in picture quality is achieved.

Besides, the electrooptic device is characterized in that the control device outputs pulse signals for bringing the respective pixels into the non-transmissive states, in, at least, the last of the subfields of the pertinent field. Thus, a black display of short time can be inserted before displaying the next field, and the adjacent fields are not continuously displayed, but are intermittently displayed, so that the recognizability of the dynamic picture image is enhanced.

Besides, an electrooptic device relating to the present invention is an electrooptic device that can include pixels which include pixel electrodes disposed in correspondence with intersections between a plurality of scanning lines and a plurality of data lines, switching elements for controlling voltages to be applied to the respective pixel electrodes, an electrooptic material enclosed in intersection areas between the plurality of data lines and the plurality of scanning lines, and a counter electrode arranged in opposition to the pixel electrodes. The device can further include a scanning line drive circuit which supplies scanning signals for dividing each field into a plurality of subfields on a time base, and for rendering the switching elements conductive in each of the plurality of subfields, to the scanning lines; a data line drive circuit which supplies binary signals for designating an ON voltage or an OFF voltage and thus bringing the pixels into transmissive states or non-transmissive states on the basis of gradation data, to the data lines corresponding to the pertinent pixels, the binary signals being supplied in time periods in which the scanning signals are respectively supplied to the scanning lines corresponding to the pertinent pixels, and a control device for controlling the data line drive circuit so that pulse signals for bringing the respective pixels into the transmissive states may be concentrated in the first half of each field. The device can further include a temperature detection device for detecting the temperature of the electrooptic material itself or the ambient temperature of the electrooptic material, and pulse width correction device for making corrections so that the pulse width of the pulse signals for bringing the pixels into the transmissive states as is predetermined in correspondence with each gradation may be altered on the basis of a detection output of the temperature detection device in each field.

According to the present invention, the scanning signals for dividing each field into the plurality of subfields on the time base, and for rendering the switching elements conductive in each of the plurality of subfields, are supplied to the scanning lines by the scanning line drive circuit, and the binary signals for designating the ON voltage or the OFF voltage and thus bringing the pixels into the transmissive states or the non-transmissive states on the basis of the gradation data in each of the subfields, are supplied to the data lines correspondent to the pertinent pixels by the data line drive circuit in the time periods in which the scanning signals are respectively supplied to the scanning lines correspondent to the pertinent pixels, whereby the respective pixels present gradational displays. Herein, the data line drive circuit is controlled by the control device so that the pulse signals for bringing the respective pixels into the transmissive states may be concentrated in the first half of each field.

In addition, the temperature of the electrooptic material itself or the ambient temperature of the electrooptic material can be detected by the temperature detection device, and the pulse width of the pulse signals for bringing the pixels into the transmissive states as is predetermined in correspondence with each gradation is altered on the basis of the detection output of the temperature detection device in each field by the pulse width correction device.

Thus, even when the response rate of a liquid crystal being the electrooptic material changes depending upon the temperature of the liquid crystal or the ambient temperature of the liquid crystal, a gradation characteristic can be held constant, and the deterioration of the gradation characteristic attributed to the temperature change can be relieved, so that enhancement in picture quality is achieved.

With an electronic equipment relating to the present invention, owing to the above electrooptic device included therein, a time period in which the liquid crystal as the electrooptic material constituting the pixels reaches a target transmission factor can be shortened to heighten the response rate, with the result that enhancement in picture quality is achieved.

Besides, with an electronic equipment relating to the present invention, owing to the above electrooptic device included therein, in the case where the display content changes at the changeover of the fields in displaying the dynamic picture image, the response characteristic of the liquid crystal as the electrooptic material constituting the pixels can be bettered so that desired gradations may be quickly attained in the direction in which screen brightness changes, and enhancement in picture quality is achieved.

Besides, with an electronic equipment relating to the present invention, owing to the above electrooptic device included therein, a black display of short time can be inserted before displaying the next field, and the adjacent fields are not continuously displayed, but are intermittently displayed, so that the recognizability of the dynamic picture image is enhanced.

Further, with an electronic equipment relating to the present invention, owing to the above electrooptic device included therein, even when the response rate of a liquid crystal being the electrooptic material changes depending upon the temperature of the liquid crystal or the ambient temperature of the liquid crystal, a gradation characteristic can be held constant, and the deterioration of the gradation characteristic attributed to the temperature change can be relieved, so that enhancement in picture quality is achieved.

Besides, the present invention has been made in order to accomplish the object mentioned before, and includes a drive method of an electrooptic device that divides each field into a plurality of subfields on a time base, and controls the subfields for bringing into a transmissive state each of a plurality of pixels which include an electrooptic material enclosed in intersection areas between a plurality of data lines and a plurality of scanning lines, by an ON voltage or an OFF voltage in accordance with display data, whereby the respective pixels display gradations within one field by a subfield drive scheme, characterized by bringing at least one of the subfields in which the pertinent pixel is to be brought into the transmissive state and which are successively arranged in the first half of the pertinent field on the basis of the display data, into a non-transmitting condition in conformity with rules stipulated by the display data.

Besides, the present invention is characterized in that, among the subfields in which the pertinent pixel is to be brought into the transmissive state and which are successively arranged in the first half of the pertinent field on the basis of the display data, at least one subfield other than the subfield where the transmissive state starts but which lies in the vicinity thereof is brought into the non-transmitting condition in conformity with the rules stipulated by the display data.

Besides, the present invention is characterized in that, among the subfields in which the pertinent pixel is to be brought into the transmissive state and which are successively arranged in the first half of the pertinent field on the basis of the display data, at least one subfield other than the subfield where the transmissive state ends but which lies in the vicinity thereof is brought into the non-transmitting condition in conformity with the rules stipulated by the display data.

Besides, the present invention can include a drive circuit of an electrooptic device having pixels which include pixel electrodes disposed in correspondence with intersections between a plurality of scanning lines and a plurality of data lines, switching elements for controlling voltages to be applied to the respective pixel electrodes, an electrooptic material enclosed in intersection areas between the plurality of data lines and the plurality of scanning lines, and a counter electrode arranged in opposition to the pixel electrodes, wherein the drive circuit controls the subfields for bringing each of the pixels into a transmissive state, by an ON voltage or an OFF voltage, whereby the respective pixels display gradations within one field by a subfield drive scheme. The present invention can also include a control device for performing control so that at least one of the subfields in which the pertinent pixel is to be brought into the transmissive state and which are successively arranged in accordance with display data may be brought into a non-transmitting condition on the basis of the display data.

Besides, the present invention can include pixels which include pixel electrodes disposed in correspondence with intersections between a plurality of scanning lines and a plurality of data lines, switching elements for controlling voltages to be applied to the respective pixel electrodes, an electrooptic material enclosed in intersection areas between the plurality of data lines and the plurality of scanning lines, and a counter electrode arranged in opposition to the pixel electrodes; a scanning line drive circuit which supplies scanning signals for dividing each field into a plurality of subfields on a time base, and for rendering the switching elements conductive in each of the plurality of subfields, to the scanning lines, and a control device for controlling a data line drive circuit so that pulse signals for bringing the respective pixels into transmissive states may be concentrated in the first half of the field, and that at least one of the pulse signals which bring the pixels into the transmissive states and which are successively arranged may be brought into a non-transmitting condition in accordance with display data.

Besides, the present invention can include an electronic equipment having the above electrooptic device.

BRIEF DESCRIPTION OF THE DRAWINGS

The invention will be described with reference to the accompanying drawings wherein like numerals represent like elements, and wherein.

DETAILED DESCRIPTION OF PREFERRED EMBODIMENTS

Figure 1:
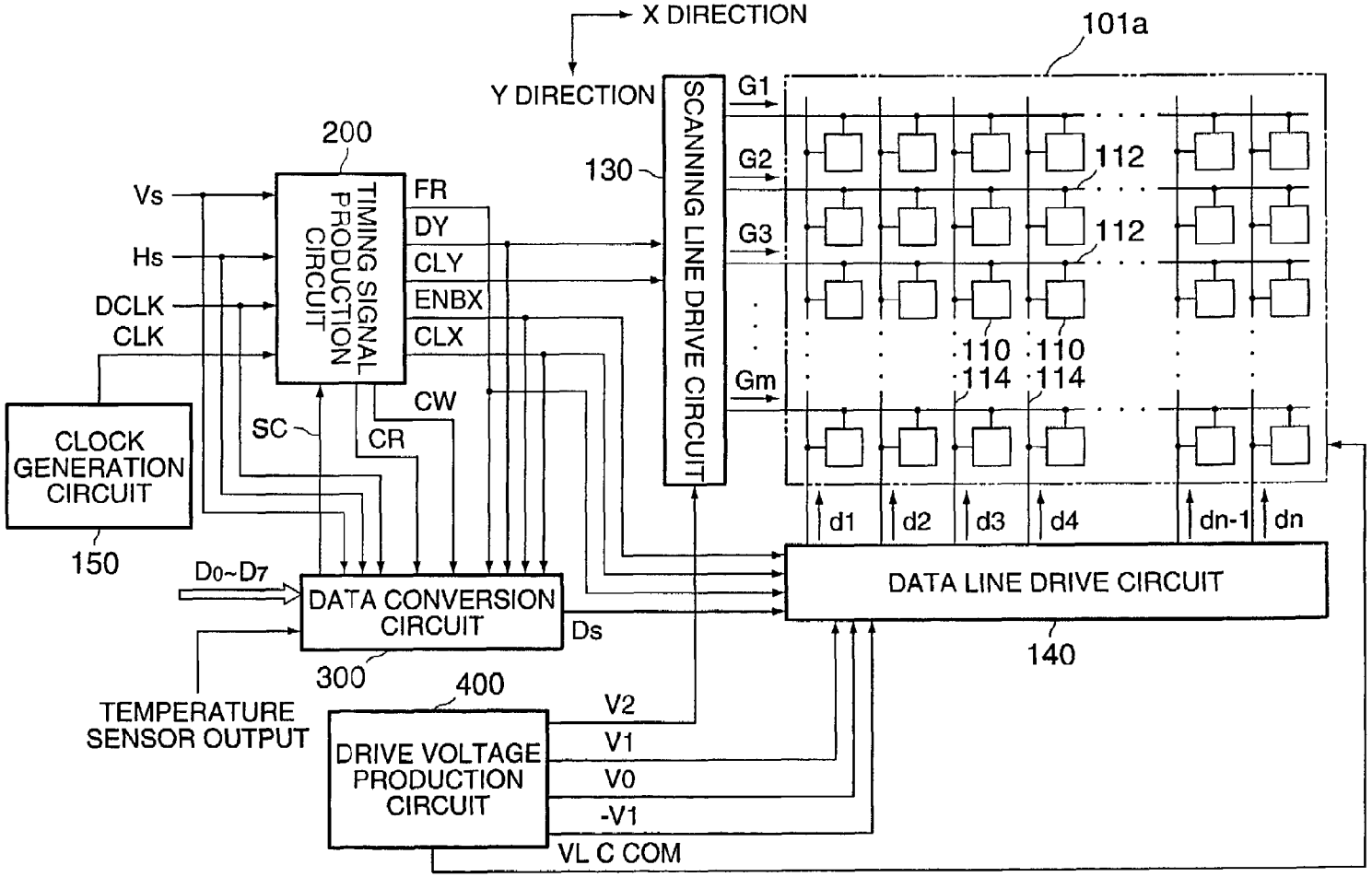
FIG. 1 is a block diagram showing an electrooptic device relating to the first embodiment of the present invention.
Figure 2:
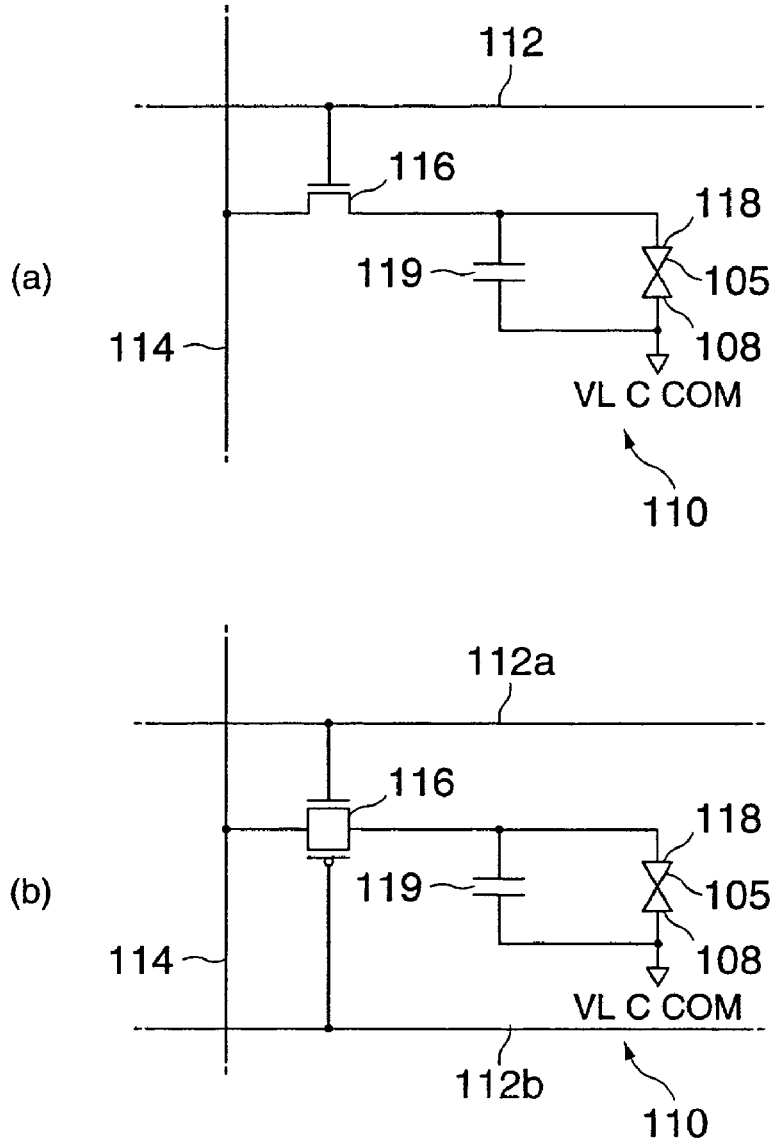
FIG. 2 is an explanatory diagram showing practicable constructions of pixels in FIG. 1.

Now, embodiments of the present invention will be described in detail with reference to the drawings. FIG. 1 is a block diagram showing an electrooptic device relating to the first embodiment of the present invention. FIG. 2 is an explanatory diagram showing practicable constructions of pixels in FIG. 1.

The electrooptic device relating to this embodiment is, for example, a liquid crystal device which employs a liquid crystal as an electrooptic material. As will be described later, the device can be constructed so that an element substrate and an opposing substrate are stuck to each other with a predetermined gap defined therebetween, and that the liquid crystal being the electrooptic material is sealed in the gap. Incidentally, here in the description, it is assumed that the display mode of the electrooptic device is "normally black", so a white display is presented in a state in which a voltage is applied to each pixel (ON state), whereas a black display is presented in a state in which no voltage is applied thereto (OFF state).

In the electrooptic device relating to this embodiment, a transparent substrate, such as glass substrate, is employed as the element substrate, and peripheral drive circuits etc. are formed here together with transistors which drive pixels. On the other hand, in a display area 101*a* on the element substrate, a plurality of scanning lines 112 are formed extending in the X (row) direction as viewed in the figure, and a plurality of data lines 114 are formed extending in the Y (column) direction. Besides, the pixels 110 are disposed in correspondence with the respective intersections of the scanning lines 112 and the data lines 114 and are arrayed in the shape of a matrix.

Here, for brevity of the description, this embodiment is assumed to be a matrix type display device of m rows×n columns (where each of m and n denotes an integer of at least 2) in which the total number of the scanning lines 112 is m, while the total number of the data lines 114 is n. However, it should be understood that the present invention is not limited to this.

An exemplary construction of each pixel 110 is, for example, shown in FIG. 2(*a*). In this construction, the gate of each transistor (TFT: thin film transistor) 116 being switching means is connected to the scanning line 112, the source thereof to the data line 114, and the drain thereof to a pixel electrode 118, and the liquid crystal 105 being the electrooptic material is sandwiched in between the pixel electrode 118 and a counter electrode 108, thereby to form a liquid crystal layer. Here, the counter electrode 108 is actually a transparent electrode which is formed on the whole surface of the opposing substrate so as to oppose to such pixel electrodes 118, as will be stated later.

Incidentally, a counter electrode voltage VLCCOM is applied to the counter electrode 108. Besides, a storage capacitance 119 is formed between the pixel electrode 118 and the counter electrode 108, and it stores charges together with the electrodes holding the liquid crystal layer therebetween. Incidentally, although the storage capacitance 119 is formed between the pixel electrode 118 and the counter electrode 108 in the example of FIG. 2(*a*), it may well be formed, e.g., between the pixel electrode 118 and a ground potential GND or between the pixel electrode 118 and a gate line.

In the construction shown in FIG. 2(*a*), only one channel type is employed as the transistor 116, and hence, an offset voltage is required for canceling the polarity difference between positive and negative voltages attributed to transistor characteristics etc. With a construction in which, as shown in FIG. 2(*b*), a P-channel type transistor and an N-channel type transistor are complementarily combined, the influence of the polarity difference can be lessened without employing the offset voltage. In the complementary type construction, however, signals of levels exclusive to each other need to be supplied as scanning signals, so that two scanning lines 112*a*, 112*b* are required for the pixels 110 of one row.

Scanning signals G1, G2, . . . Gm are respectively supplied from a scanning line drive circuit 130 to be explained later, to the individual scanning lines 112. The transistors 116 constituting the pixels of the respective lines are brought into conductive states by the corresponding scanning signals, whereby picture signals supplied from a data line drive circuit 140 to be explained later, to the individual data lines 114, are respectively supplied to the pixel electrodes 118. The orientation state of the molecule aggregate of the liquid crystal 105 is varied in accordance with the differences between the potentials of the counter electrode 21 and the pixel electrodes 9*a* subjected to writing, so that light is modulated to realize a gradational display.

In this embodiment, subfield drive is adopted as a driving method for the liquid crystal 105. In the case of displaying a half tone in analog drive, the liquid crystal 105 is driven by a voltage which is lower than a drive voltage saturating the transmission factor of the liquid crystal (hereinbelow, termed "liquid-crystal saturation voltage"). Accordingly, the transmission factor of the liquid crystal 105 is substantially proportional to the drive voltage, and a screen at a brightness proportional to the drive voltage is obtained.

Figure 8:
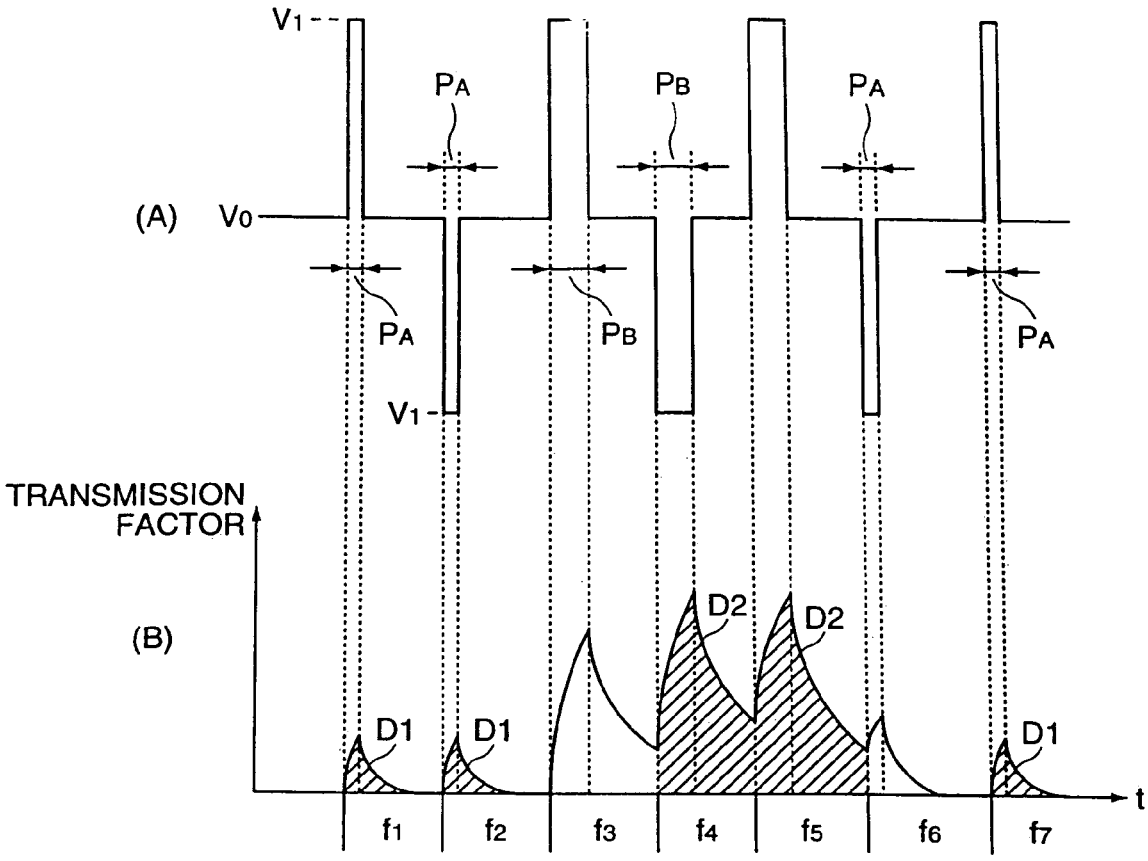
FIG. 8 is an explanatory diagram showing the relationship between the drive voltage waveform of a liquid crystal in each field in the mode of writing pixel data on the basis of the subfield drive and the changing state of the transmission factor of the liquid crystal in each field.

In contrast, the subfield drive uses only the two drive voltages of a drive voltage which brings the liquid crystal into a transmissive state, and a drive voltage which brings the liquid crystal into a non-transmissive state, and it controls the transmission factor of the liquid crystal in accordance with how the drive voltages of each subfield are combined. Incidentally, as shown in FIG. 8 to be referred to later, the brightness of a screen is actually proportional to the integral value of a transmission factor. For brevity of description, however, it is assumed in this embodiment that the brightness of the screen is proportional to the application time period of the drive voltage.

Figure 6:
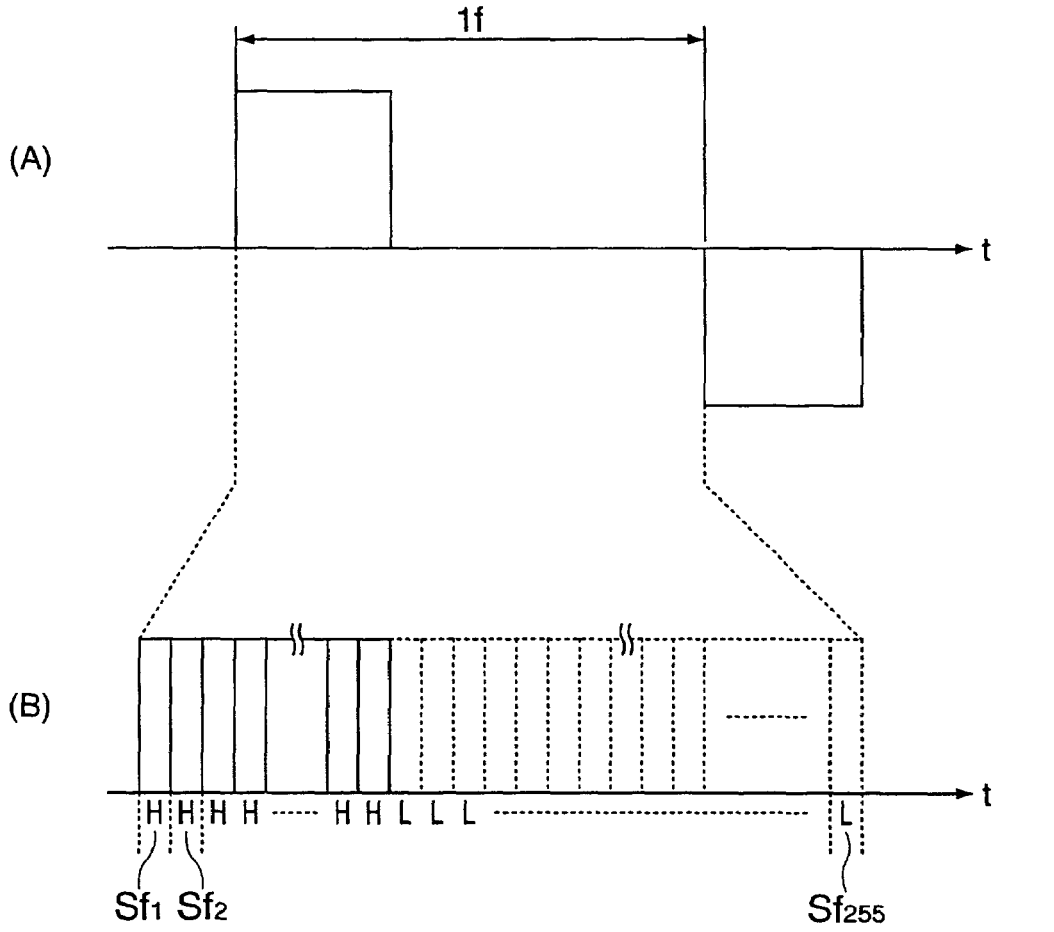
FIG. 6 is a timing chart showing individual subfield periods in subfield drive.

In this embodiment, one field is divided into a plurality of subfields on a time base. By way of example, one field period (1*f*) as shown at (a) in FIG. 6 is substantially equally divided into a plurality of subfield periods Sf1–Sf255 so as to control the drive of the liquid crystal in every subfield period. Although the dividing number of 255 is exemplified in FIG. 6, one field period (1*f*) may be divided into any plurality of subfield periods Sf1–Sfn.

Incidentally, the example of FIG. 6 is applied to an exemplary case where gradation data which indicates a gradation to be displayed for each pixel is expressed by 8 bits, and where the number of displayable gradations is 256. It is the example in which one field period is divided into the 255 subfield periods Sf1–Sf255.

In the case of presenting the gradational display, drive control is performed so that each pixel may fall into an ON state or OFF state in each of the subfield periods Sf1–Sf255 on the basis of designated gradation data.

In this embodiment, as shown in FIG. 6, the subfield periods in a number corresponding to the gradation from the start of the field period are brought into the ON state in each field.

More specifically, a pulse signal (pixel data) which has a pulse width corresponding to one subfield period Ts is employed as a drive signal for driving the liquid crystal. Besides, assuming that the brightness to be displayed is equivalent to N/256 gradations, control is performed so that the pulse signal may be outputted for a time period corresponding to N subfields, namely, for (Ts×N). In other words, control may be performed so that the pulse signals (drive signals) each having a pulse width correspondent to the subfield period Ts may be successively outputted to the number N from the start time of the field. The pulse signals (pixel data) are written into all the pixels at the intervals of the 255 subfields. Incidentally, the pulse signal is a binary signal of H (ON signal) or L (OFF signal).

Next, the electrical construction of the electrooptic device will be described. Referring to FIG. 1, the electrooptic device relating to this embodiment includes the scanning line drive circuit 130, the data line drive circuit 140, a clock generation circuit 150, a timing signal production circuit 200, a data conversion circuit 300, and a drive voltage production circuit 400.

The clock generation circuit 150 generates a clock signal CLK which serves as the reference of the control operations of various portions, and it delivers the generated signal to the timing signal production circuit 200. The timing signal production circuit 200 is a circuit in which various timing signals, clock signals etc. to be explained below are produced in accordance with the clock signal CLK as well as a vertical scanning signal Vs, a horizontal scanning signal Hs and a dot clock signal DCLK that are supplied from a host device not shown.

The timing signal production circuit 200 produces an alternation signal FR, a start pulse DY, a scanning side transfer clock CLY, a data enable signal ENBX and a data transfer clock CLX. The alternation signal FR is a signal for inverting a data writing polarity in each field. The start pulse DY is a pulse signal which is outputted at the start timing of each subfield. The scanning side transfer clock CLY is a signal which stipulates the horizontal scanning of a scanning side (Y side). The data enable signal ENBX is a pulse signal which determines a timing for starting data transfer to the data line drive circuit and for outputting data to the pixels every scanning line, and it is outputted in synchronism with the level shift (namely, rise or fall) of the scanning side transfer clock CLY. The data transfer clock CLX is a signal which stipulates a timing for transferring data to the data line drive circuit.

The drive voltage production circuit 400 produces a voltage V2 for producing a scanning signal and affords the produced voltage to the scanning line drive circuit 130, it produces voltages V1, −V1 and V0 for producing data line drive signals and affords the produced voltages to the data line drive circuit 140, and it produces the counter electrode voltage VLCCOM and applies the produced voltage to the counter electrode 108.

The voltage V1 is the voltage of the data line drive signal which is outputted as a high level signal of positive polarity with respect to the voltage V0, to the liquid crystal layer when the alternation drive signal FR is at a low level (hereinbelow, termed "L level"), while the voltage −V1 is the voltage of the data line drive signal which is outputted as a high level signal of negative polarity with respect to the voltage V0, to the liquid crystal layer when the alternation drive signal FR is at a high level (hereinbelow, termed "H level").

As described above, in this embodiment, one field is divided into the plurality of subfields Sf1–Sf255 on the time base, and the binary voltage is applied to the liquid crystal layer in each of the subfields Sf1–Sf255 in correspondence with the gradation data. The changeover of the respectively adjacent subfields is controlled by the start pulse DY. The start pulse DY is produced inside the timing signal production circuit 200.

Figure 3:
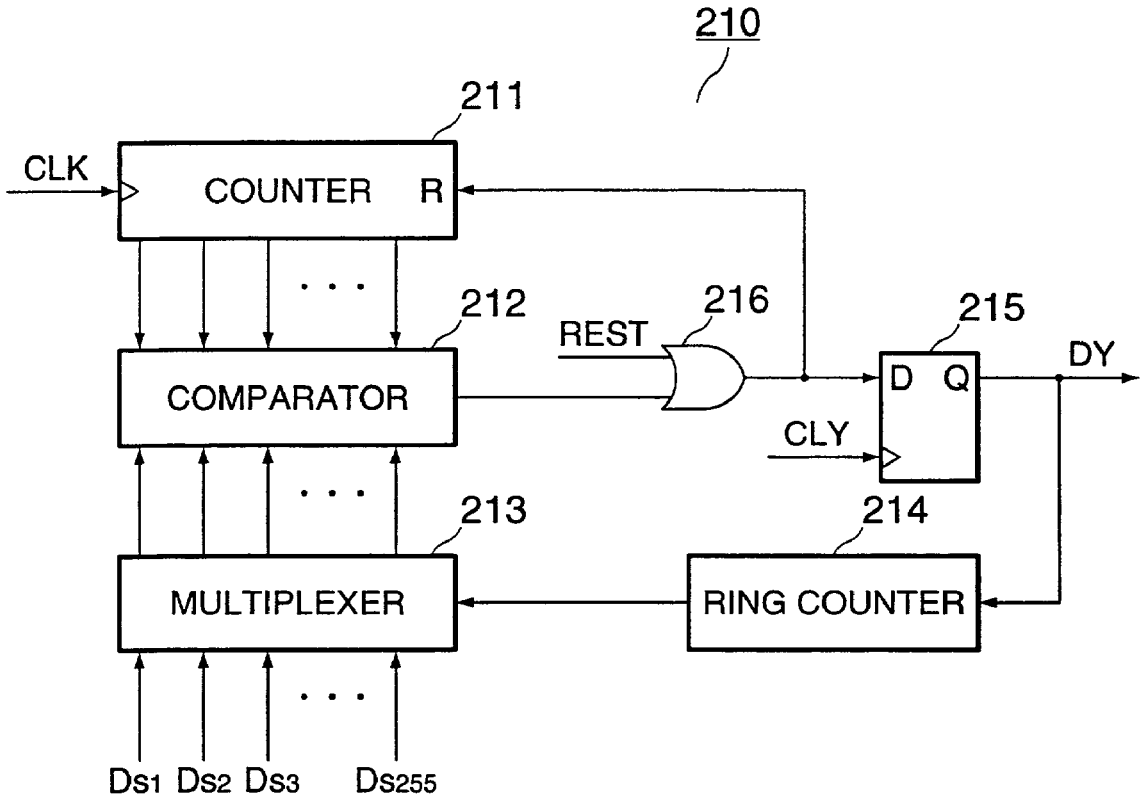
FIG. 3 is a circuit diagram showing a practicable construction of a start pulse production circuit which is contained in a timing signal production circuit 200 and which produces a start pulse DY.

FIG. 3 is a circuit diagram showing a practicable construction of a start pulse production circuit which is contained in the timing signal production circuit 200 and which produces the start pulse DY. As shown in FIG. 3, the start pulse production circuit 210 is constructed of a counter 211, a comparator 212, a multiplexer 213, a ring counter 214, a D flip-flop 215, and an OR circuit 216.

The counter 211 counts the pulses of the clock CLK, and has its count value reset by the output signal of the OR circuit 216. Besides, one input terminal of the OR circuit 216 is supplied with a reset signal RSET which becomes the H level during one cycle of the clock CLK at the start of the field. Accordingly, the counter 211 has the count value reset at, at least, the start time of the field.

The comparator 212 compares the count value of the counter 211 and the output data value of the multiplexer 213, and it outputs a coincidence signal of the H level when both the values coincide. The multiplexer 213 selectively outputs data Ds1, Ds2, . . . , Ds255 on the basis of the count result of the ring counter 214 which counts the number of the start pulses DY. Here, the data Ds1, Ds2, . . . , Ds255 correspond respectively to the subfield periods Sf1, Sf2, . . . , Sf255 shown in FIG. 6.

It is also allowed to detect the temperature of the liquid-crystal display device or the ambient temperature of the liquid-crystal display device by a temperature sensor, and to vary the values of the data Ds1, Ds2, . . . , Ds255 in conformity with the temperature characteristic of the liquid crystal on the basis of the detected temperature. Incidentally, when the length of the subfield Sf1 (1=1–255) is varied in conformity with the temperature characteristic of the liquid crystal in this manner, the effective value of the voltage to be applied to the liquid crystal can be changed in keeping with the change of the environmental temperature, and hence, the gradations and contrast ratio of a display can be held constant in spite of the temperature change.

Besides, the comparator 212 outputs the coincidence signal when the count value of the counter coincides with the output signal from the multiplexer that indicates the delimiter of the subfield. Since the coincidence signal is fed back to the reset terminal of the counter 211 through the OR circuit 216, the counter 211 starts counting again from the delimiter of the subfield. Besides, the D flip-flop 215 synchronizes the output signal of the OR circuit 216 with the scanning side transfer clock CLY, thereby to produce the start pulse DY.

The scanning line drive circuit 130 transfers the start pulse DY supplied at the beginning of each subfield, in accordance with the clock signal CLY, so as to sequentially and exclusively supply the scanning signals G1, G2, G3, . . . , Gm to the respective scanning lines 112.

The data line drive circuit 140 sequentially latches the binary signals Ds in the number n corresponding to the number of the data lines 114, in a certain horizontal scanning period, whereupon it simultaneously supplies the n latched binary signals Ds as data signals d1, d2, d3, . . . , dn to the respectively corresponding data lines 114 in the next horizontal scanning period.

Figure 4:
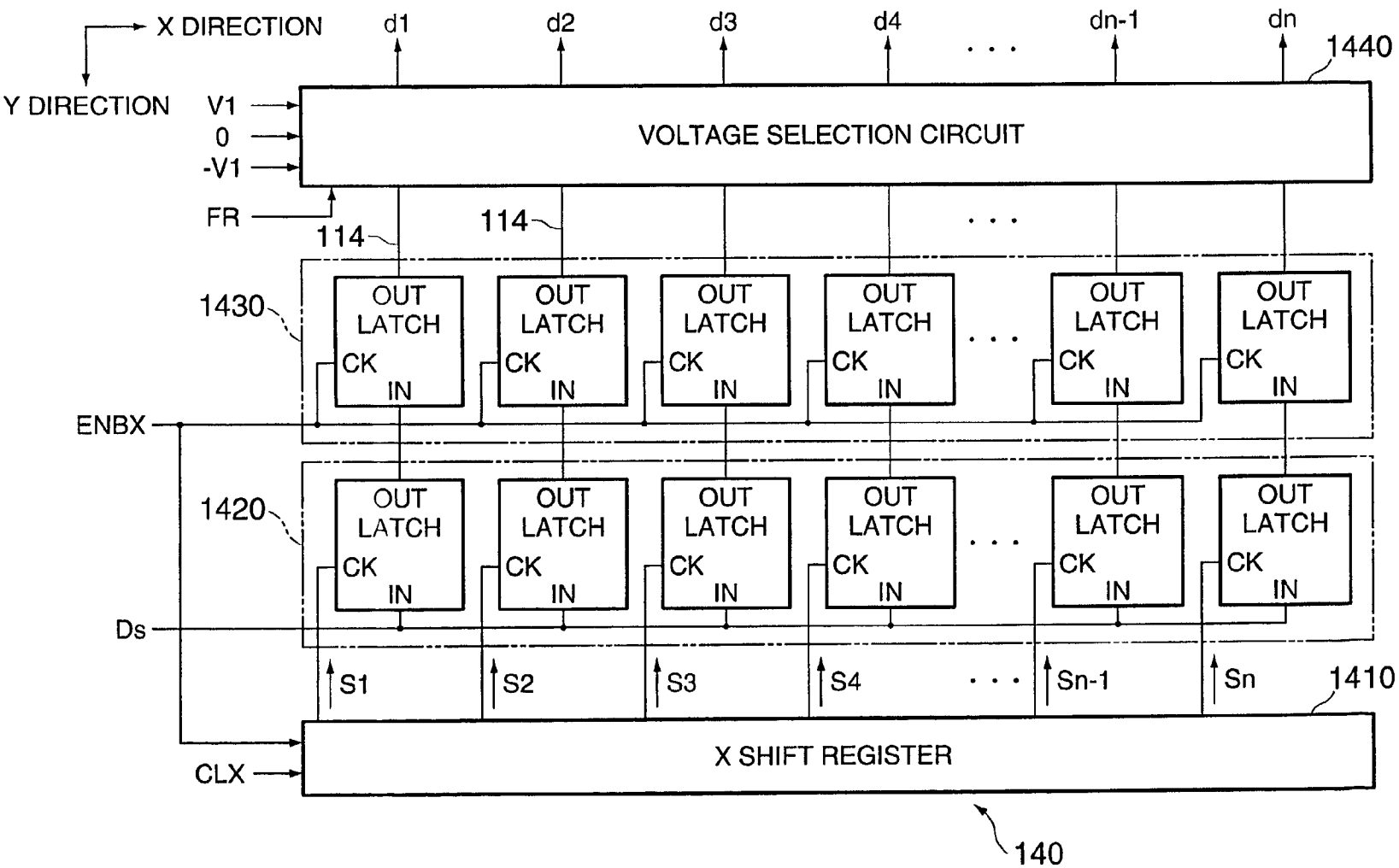
FIG. 4 is a block diagram showing a practicable construction of a data line drive circuit 140 in FIG. 1.

FIG. 4 is a block diagram showing an exemplary construction of the data line drive circuit 140 in FIG. 1. As shown in FIG. 4, the data line drive circuit 140 can be constructed of an X shift register 1410, a first latch circuit 1420, a second latch circuit 1430 and a voltage selection circuit 1440.

The X shift register 1410 transfers the data enable signal ENBX supplied at the beginning of the horizontal scanning period, in accordance with the clock signal CLX, so as to sequentially and exclusively supply latch signals S1, S2, S3, . . . , Sn. Next, the first latch circuit 1420 sequentially latches the binary signals Ds at the falls of the latch signals S1, S2, S3, . . . , Sn. Besides, the second latch circuit 1430 simultaneously latches the respective binary signals Ds latched by the first latch circuit 1420, in accordance with the data enable signal ENBX, and it supplies the latched signals to the respective data lines 114 through the voltage selection circuit 1440 as the data signals d1, d2, d3, . . . , dn.

The voltage selection circuit 1440 selects voltages corresponding to the data signals d1, d2, d3, . . . , dn, in accordance with the levels of the alternation signal FR. By way of example, in cases subject to the H level of the alternation signal FR where a data signal for bringing a certain pixel into the ON state is to be outputted, the voltage −V1 is selected, and where a data signal for bringing a certain pixel into the OFF state is to be outputted, the voltage V0 is selected. Besides, in cases subject to the L level of the alternation signal FR where a data signal for bringing a certain pixel into the ON state is to be outputted, the voltage V1 is selected, and where a data signal for bringing a certain pixel into the OFF state is to be outputted, the voltage V0 is selected.

As stated above, with the subfield drive, each pixel is brought into the ON state or the OFF state in each of the subfield periods Sf1–Sf255 in correspondence with the brightness of the pixel to be displayed. The data of the brightness of each pixel to be displayed (hereinbelow, termed "gradation data") needs to be converted into the binary signal Ds of the H level or L level for bringing the pixel into the ON state or OFF state every subfield period.

The data conversion circuit 300 in FIG. 1 is disposed for this purpose, and it corresponds to the control device. This data conversion circuit 300 operates in synchronism with the vertical scanning signal Vs, horizontal scanning signal Hs and dot clock signal DCLK, writes one of the gradation data D0–D7 of 8 bits which corresponds to each pixel into a field memory, it reads the data out of a field memory in synchronism with the start pulse DY, and it converts the read-out 8-bit gradation data D0–D7 into the binary signal Ds for each of the subfields Sf1–Sf255, so as to supply the binary signal Ds to each pixel.

The data conversion circuit 300 necessitates a construction for recognizing the subfield in which the data is being currently written, within one field. The construction can be accomplished by, for example, the following method. In this embodiment, the alternation signal FR which is inverted every field is produced for the alternation drive. Therefore, a counter which counts the number of the start pulses DY and whose count result is reset at the level shift (rise or fall) of the alternation signal FR is disposed in the data conversion circuit 300, and the count result is referred to, whereby the subfield in which the data is being currently written can be recognized.

In this embodiment, in order to realize the gradation (brightness) designated for each pixel by the 8-bit gradation data D0–D7, the data conversion circuit 300 is so constructed that pulse signals being of the ON voltage, each having a pulse width corresponding to one subfield period, are outputted in the number of the gradations and in concentrated fashion in the first half of the field period.

Further, the field memories in the data conversion circuit 300 are disposed for two fields. The first field memory is a memory into which the inputted gradation data (picture data) are written, while the second memory is a memory in which the gradation data of each pixel having been written into the first field memory one field earlier are stored. While the gradation data are being written into the first field memory, the gradation data are read out of the second field memory for each pixel.

Besides, the detection output of the temperature sensor for detecting the temperature of the liquid crystal itself or the ambient temperature of the liquid crystal is inputted to the data conversion circuit 300. The temperature sensor not shown corresponds to temperature detection means, and the data conversion circuit 300 to pulse width correction means.

The data conversion circuit 300 generates a control signal SC for making corrections so as to alter the values of the data Ds1, Ds2, . . . , Ds255 which are to be inputted to the multiplexer 213 in the start pulse production circuit 210, on the basis of the detection output of the temperature sensor, and it outputs the control signal SC to the timing signal production circuit 200. The timing signal production circuit 200 can alter the output timing of the start pulse DY in accordance with the control signal SC so as to alter the period of each of the subfields Sf1–Sf255 in correspondence with the change of the response rate of the liquid crystal.

Incidentally, since the binary signal Ds needs to be outputted in synchronism with operations in the scanning line drive circuit 130 and data line drive circuit 140, the data conversion circuit 300 is supplied with the start pulse DY, the scanning side transfer clock CLY synchronous with the horizontal scanning, the data enable signal ENBX stipulating the timing for starting the transfer of the data to the data line drive circuit, and the data transfer clock CLX.

Besides, as stated above, the data line drive circuit 140 is so constructed that, after the first latch circuit 1420 has latched the binary signals point-sequentially in a certain horizontal scanning period, the latched binary signals are simultaneously supplied from the second latch circuit 1430 to the respectively corresponding data lines 114 as the data signals d1, d2, d3, . . . , dn in the next horizontal scanning period. Therefore, the data conversion circuit 300 is constructed so as to output the binary signals Ds at a timing which precedes the operations in the scanning line drive circuit 130 and data line drive circuit 140 one horizontal scanning period.

Figure 5:
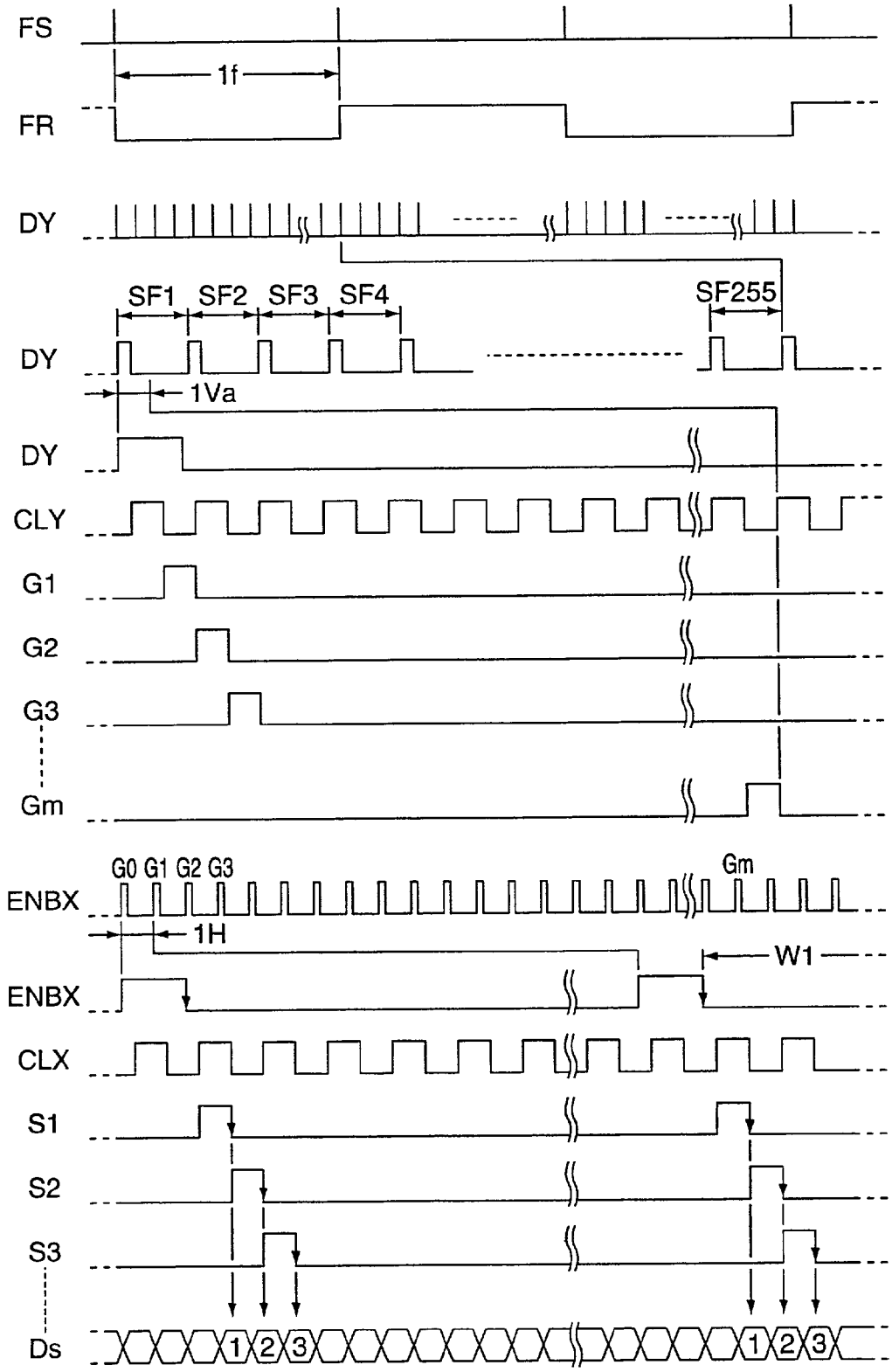
FIG. 5 is a timing chart for explaining the operation of the electrooptic device.

Next, the operation of the electrooptic device relating to the above embodiment will be described. FIG. 5 is a timing chart for explaining the operation of the electrooptic device.

The alternation signal FR is the signal whose level is inverted every field period (1*f*). The start pulse DY is generated at the start of each of the subfields Sf1–Sf255. When the start pulse DY is supplied in the field period (1*f*) in which the alternation signal FR is at the L level, the scanning signals G1, G2, G3, . . . , Gm are sequentially and exclusively outputted in a time period (t) by transfers according to the clock signal CLY in the scanning line drive circuit 130 (refer to FIG. 1). By the way, in this embodiment, basically one field is equally divided by 255, and the individual subfields have equal time widths. In some cases, however, the individual subfield periods are altered in correspondence with the change of the temperature of the liquid crystal itself or the ambient temperature of the liquid crystal. Therefore, the time period (t) is set at a time period which is still shorter than the shortest subfield period.

Each of the scanning signals G1, G2, G3, . . . , Gm has a pulse width equal to a half cycle of the clock signal CLY. Besides, the scanning signal G1 which corresponds to the first scanning line 112 as reckoned from above is outputted with a delay of, at least, the half cycle of the clock signal CLY after the first rise of the clock signal CLY after the start pulse DY has been supplied. Accordingly, one clock pulse (G0) of the data enable signal ENBX is supplied to the data line drive circuit 140 in a time interval after the supply of the start pulse DY until the output of the scanning signal G1.

It is now assumed that one clock pulse (G0) of the data enable signal ENBX has been supplied. When one clock pulse (G0) of the data enable signal ENBX has been supplied to the data line drive circuit 140, the latch signals S1, S2, S3, . . . , Sn are sequentially and exclusively outputted in the horizontal scanning period (1H) by the transfers according to the clock signal CLX in the data line drive circuit 140 (refer to FIG. 4). Incidentally, each of the latch signals S1, S2, S3, . . . , Sn has a pulse width equal to a half cycle of the clock signal CLX.

On this occasion, the first latch circuit 1420 in FIG. 4 latches the binary signal Ds for the pixel 110 which corresponds to the intersection between the first scanning line 112 as determined from above and the first data line 114 as determined from the left, at the fall of the latch signal S1. Subsequently, it latches the binary signal Ds for the pixel 110 which corresponds to the intersection between the first scanning line 112 as determined from above and the second data line 114 as determined from the left, at the fall of the latch signal S2. Thenceforth, it similarly latches the binary signal Ds for the pixel 110 which corresponds to the intersection between the first scanning line 112 as determined from above and the nth data line 114 as determined from the left.

Thus, first of all, the binary signals Ds for the pixels of one row which correspond to the intersections with the first scanning line 112 from above in FIG. 1 are point-sequentially latched by the first latch circuit 1420. It is needless to say that the data conversion circuit 300 sequentially produces the binary signals Ds corresponding to the individual subfields, from the gradation data D0–D7 of the respective pixels, and then outputs the produced signals, in conformity with the timings of the latches of the first latch circuit 1420.

Subsequently, when the clock signal CLY has fallen to output the scanning signal G1, the first scanning line 112 as reckoned from above in FIG. 1 is selected, with the result that all the transistors 116 of the pixels 110 corresponding to the intersections with the pertinent scanning line 112 fall into conductive states.

On the other hand, the data enable signal ENBX is outputted by the fall of the pertinent clock signal CLY. Besides, at the fall timing of the data enable signal ENBX, the second latch circuit 1430 simultaneously supplies the binary signals Ds latched point-sequentially by the first latch circuit 1420, as the data signals d1, d2, d3, . . . , dn to the respectively corresponding data lines 114 through the voltage selection circuit 1440. Thus, the data signals d1, d2, d3, . . . , dn are simultaneously written into the pixels 110 of the first row as reckoned from above. Concurrently with the writing, the binary signals Ds of one row which correspond to the intersections with the second scanning line 112 from above in FIG. 1 are latched point-sequentially by the first latch circuit 1420.

Figure 7:
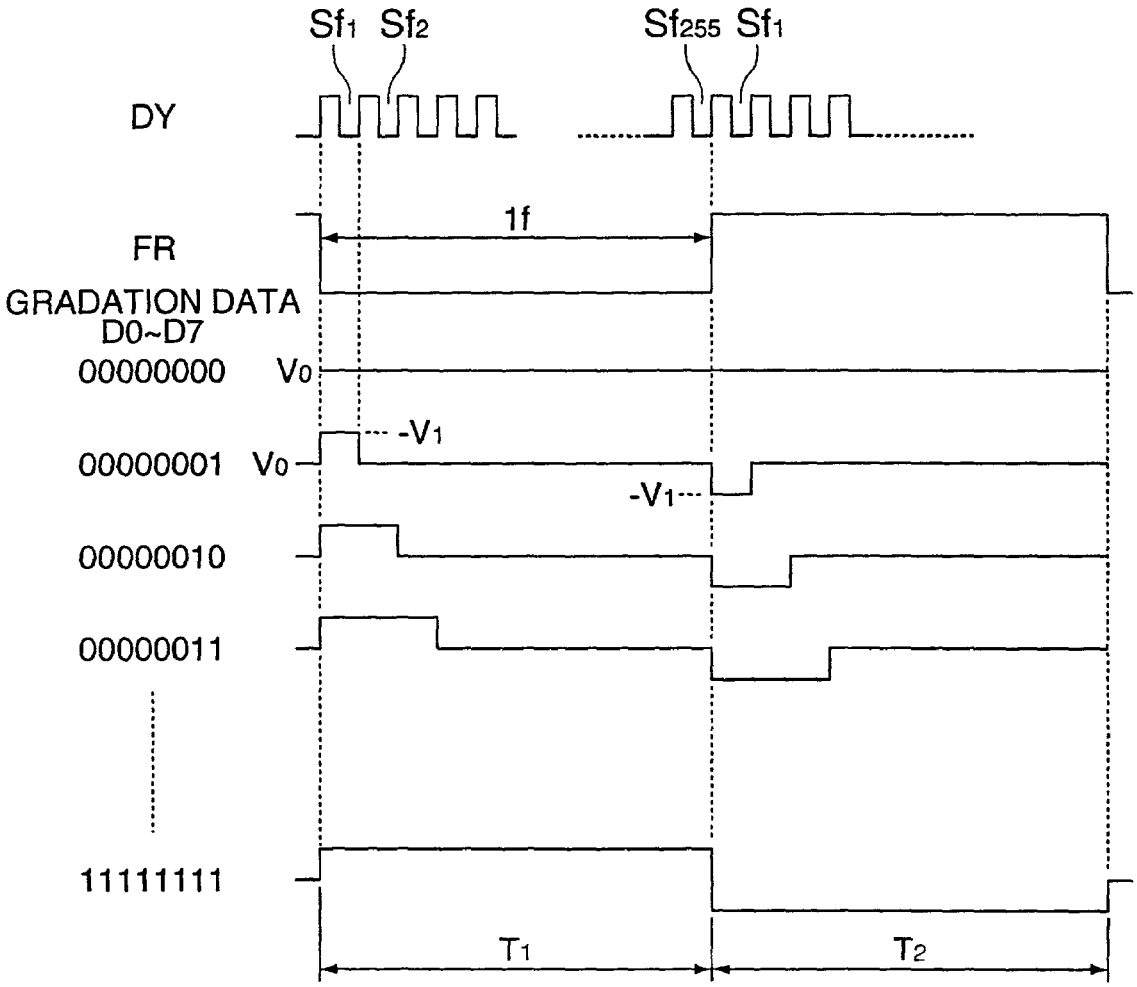
FIG. 7 is a timing chart showing in frame units an alternation signal, and voltages to be applied to each pixel electrode in the electrooptic device relating to the first embodiment.

Here, it is assumed that the gradation data D0–D7 of a certain pixel is "00000010" which indicates the third gradation (brightness) (hereinbelow, termed "second gradation") as reckoned from the dark side of the 256 gradations of the 0th through the 255th. In order to attain the designated brightness of the second gradation, the pixel may be turned ON in two of the 255 subfields. In this embodiment, in this case, as shown in FIG. 7, the voltage V1 which indicates the H level as the binary signal to be supplied to the pixel is outputted in the intervals of two subfields from the head of the field period, namely, the subfields Sf1, Sf2, and the voltage V0 which indicates the L level is outputted as the data signals from the voltage selection circuit 1440 in the other subfields Sf3–Sf255.

Besides, it is assumed by way of example that the gradation data D0–D7 of a certain pixel is "00000011" indicative of the third gradation. In this case, in order to attain the designated brightness of the third gradation, the voltage V1 which indicates the H level as the binary signal is outputted in the intervals of the subfields Sf1, Sf2, Sf3, and the voltage V0 which indicates the L level is outputted from the voltage selection circuit 1440 in the other subfields Sf4–Sf255.

In this manner, with the electrooptic device relating to this embodiment, in the case of causing each of the plurality of pixels to present a gradational display, control is performed by the data conversion circuit 300 so that the pulse signals being of the ON voltage (V1) to be impressed on each of the plurality of pixels may be concentrated in the first half of the field period.

Similar operations are repeated until the scanning signal Gm corresponding to the mth scanning line 112 is outputted. That is in one horizontal scanning period (1H) in which a certain scanning signal Gi (where i denotes an integer satisfying $1 \leqq i \leqq m$) is outputted, there concurrently proceed the writing of the data signals d1–dn into the pixels 110 of one row correspondent to the first scanning line 112, and the point-sequential latching of the binary signals Ds for the pixels 110 of one row correspondent to the (i+1)th scanning line 112. Incidentally, the data signals written into the pixels 110 are retained till writing in the next subfield Sf2.

Thereafter, similar operations are repeated each time the start pulse DY stipulating the start of each subfield period is supplied.

Further, in a case where the alternation signal FR has been inverted to the H level after the lapse of one field, similar operations are repeated in each subfield.

Figure 10:
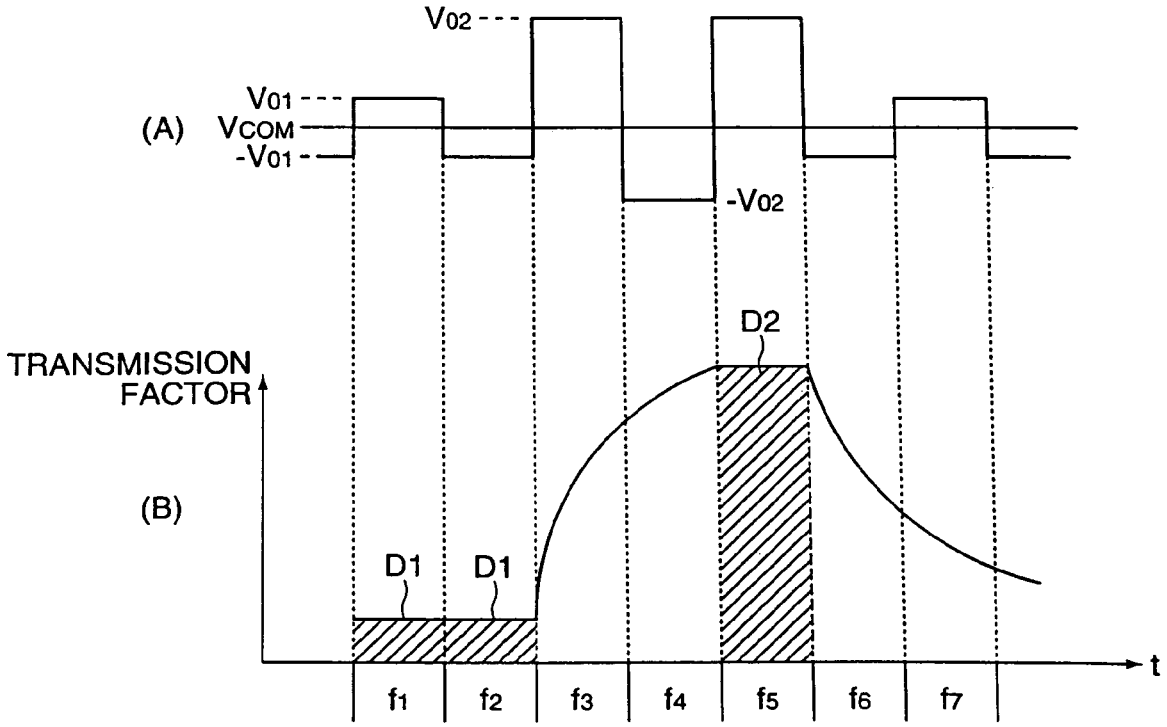
FIG. 10 is an explanatory diagram showing the relationship between the drive voltage waveform of a liquid crystal in each field in the mode of writing pixel data on the basis of analog drive in the prior art and the changing state of the transmission factor of the liquid crystal in each field.

Next, an operating state in the mode of writing pixel data into each pixel every field on the basis of the subfield drive in the above construction will be described in comparison with one in a prior-art example. FIG. 10 shows the relationship between the drive voltage waveform of a liquid crystal in each field in the mode of writing pixel data on the basis of analog drive in the prior art (FIG. 10(A)) and the changing state of the transmission factor of the liquid crystal in each field (FIG. 10(B)).

Referring to FIG. 10, in fields f1 and f2, positive and negative analog voltages V01 and −V01 corresponding to a gradation D1 are alternately applied over the two fields in order to attain the gradation (brightness) D1 to be displayed. Here, in the field f2, in altering a gradation from the gradation D1 to a gradation D2 higher than the gradation D1, drive voltages V02 and −V02 of levels corresponding to the gradation D2 are applied to the pertinent pixel over the two fields of fields f3 and f4. Since, however, the liquid crystal has a finite response time, it does not reach the target gradation D2 immediately, but it reaches the gradation D2 in a field f5 which is the third field after the changeover of the gradation.

In contrast, in the embodiment of the present invention, the gradational display is presented by the subfield drive in accordance with the time ratio, namely, the duty between those intervals of one field in which the ON voltage is applied and those intervals of the field in which the OFF voltage is applied. In that case, control is performed so as to concentrate the intervals of the ON voltage in the first half of each field period, whereby betterment in the optical response characteristic of the liquid crystal is achieved.

FIG. 8 shows the relationship between the drive voltage waveform of the liquid crystal in each field in the mode of writing pixel data on the basis of the subfield drive (FIG. 8(A)) and the changing state of the transmission factor of the liquid crystal in each field (FIG. 8(B)). Additionally in FIG. 8, a plurality of successive subfield periods in which the ON voltage is applied is expressed by one pulse, the pulse width of which corresponds to the number of subfields in which the liquid crystal is turned ON. Referring to FIG. 8(A), the levels V1 and −V1 of pulse-like voltages which are applied to the pixel in each field are selected to be about 1–1.5 times the saturation voltage Vsat of the liquid crystal. This value is favorable for the improvement of the response characteristic of the liquid crystal because rise in the response characteristic of the liquid crystal is approximately in a proportional relation with the voltage level which is applied to the pixel. Besides, owing to the control by which the pulse-like signals are concentrated in the first half part of the field, the changeover of the fields can be quickly responded to.

On the other hand, in a case where a gradation changes in the direction reverse to the rise, no electric field is applied to the liquid crystal at the end of the pertinent field, namely, at the beginning of the next field because the application of the ON signals ends midway of the pertinent field in correspondence with the display gradation. Also in this case, therefore, a response characteristic better than with the prior-art drive scheme can be attained.

Referring to FIG. 8, in fields f1 and f2, the voltages V1 and −V1 of pulse width PA corresponding to a gradation D1 are applied over the two fields so as to attain the gradation D1 to be displayed in the state in which they are concentrated in the first halves of the respective fields, whereby the target gradation D1 is attained. Here, in the field f2, in altering the gradation from the gradation D1 to a gradation D2 higher than the gradation D1, the voltages V1 and −V1 of pulse width PB corresponding to the gradation D2 are applied in fields f3, f4 and f5 in the state in which they are concentrated in the first halves of the respective fields. In this case, in the process of altering the gradation from the gradation D1 to the gradation D2, the liquid crystal reaches the target transmission factor, namely, the gradation D2 in the field f4 which is two fields after the field f2.

Also, in altering the gradation from the gradation D2 to the gradation D1 in the field f5, the liquid crystal similarly changes smoothly to the target gradation D1 in a field f7 which is the second field after the field f5. Here, the transmission factors at which the gradations D1 and D2 are respectively attained are effectively the same as in the prior-art example shown in FIG. 10(B).

In this manner, the electrooptic device relating to this embodiment having pixels including pixel electrodes which are disposed in correspondence with the respective intersections between a plurality of scanning lines and a plurality of data lines, switching elements which control voltages to be applied for the respective pixel electrodes, an electrooptic material which is sealed in the intersecting areas of the plurality of data lines and the plurality of scanning lines, and a counter electrode which is arranged in opposition to the pixel electrodes; a scanning line drive circuit for supplying the respective scanning lines with scanning signals which divide each field into a plurality of subfields and which render the switching elements conductive in each of the plurality of subfields. The device further includes a data line drive circuit for supplying binary signals which designate the ON voltage or OFF voltage of the pixels in each subfield on the basis of gradation data, thereby to bring the pixels to a white display or a black display, to the data lines correspondent to the pixels in time periods in which the scanning signals are respectively supplied to the scanning lines correspondent to the pixels, and a control device for controlling the data line drive circuit so that pulse signals being of the ON voltage to be respectively applied to the plurality of pixels may be concentrated in the first half of each field. Therefore, a response time in which a liquid crystal as the electrooptic material constituting each pixel reaches a target transmission factor can be shortened to achieve a high response rate, with the result that enhancement in picture quality can be achieved.

Besides, in the electrooptic device relating to this embodiment, in a case where display content changes at the changeover of fields in the display of a dynamic picture image, the pulse width of a pulse signal being of the ON voltage in the later field is altered in correspondence with a display gradation in accordance with the direction in which the brightness of the screen changes, whereby the response characteristic of the liquid crystal can be bettered.

Figure 9:
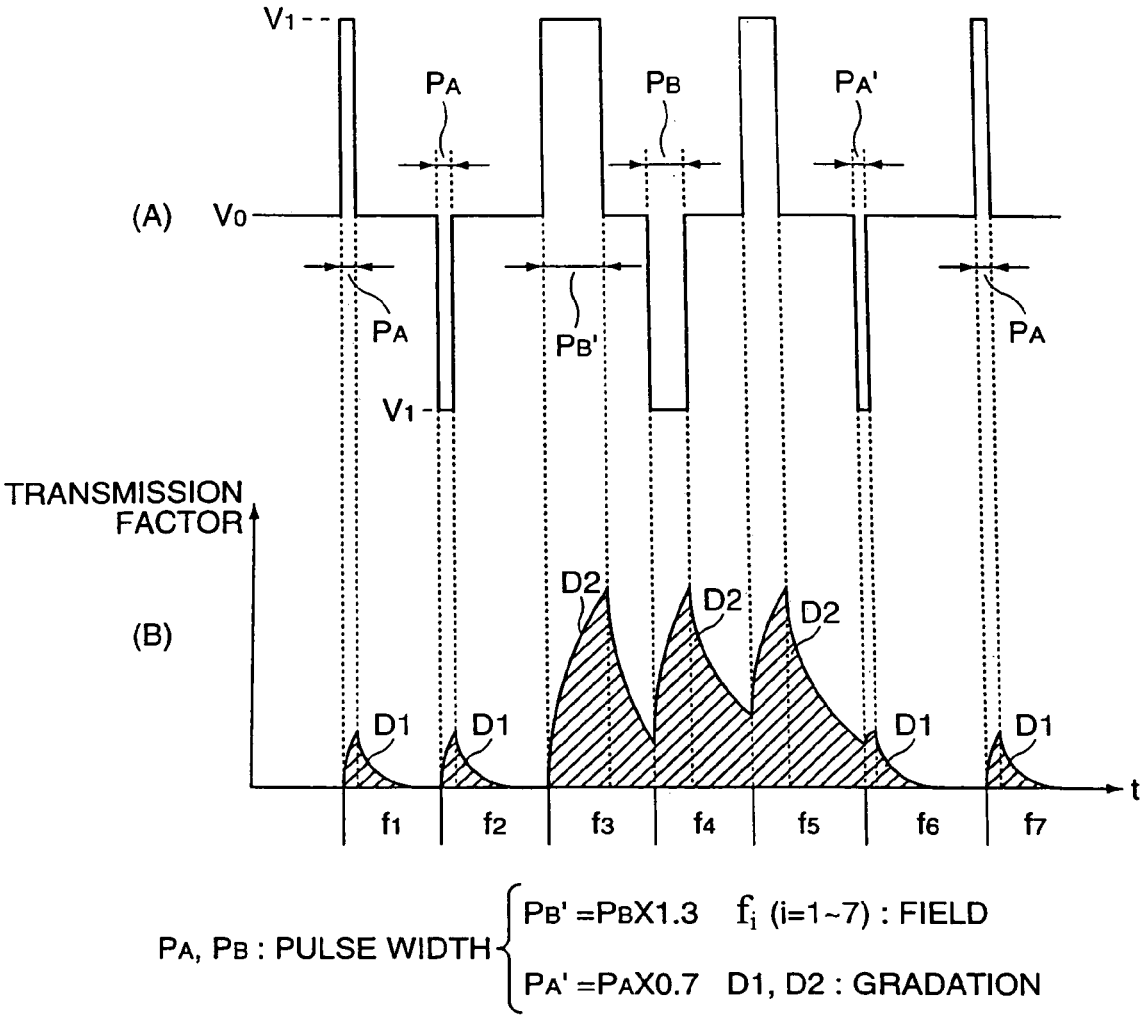
FIG. 9 is an explanatory diagram showing the state of control for writing pixel data on the basis of the subfield drive, in the case where display content changes at the changeover of fields in the display of a dynamic picture image.

Reference will be made to FIG. 9 to describe a control for writing pixel data on the basis of the subfield drive, in the case where display content changes at the changeover of fields in the display of a dynamic picture image. FIG. 9(A) shows the drive voltage waveform of the liquid crystal in each field in the mode of writing pixel data on the basis of the subfield drive, while FIG. 9(B) shows the changing state of the transmission factor of the liquid crystal in each field.

Referring to these figures, in fields f1 and f2, voltages V1 and −V1 of pulse width PA are respectively outputted to attain a target gradation D1. It is assumed that the display content changes from the field f2 over to a field f3, so the brightness, namely, gradation of a screen changes from a gradation D1 to a gradation D2. In a case where the gradation of the screen changes in a higher direction in this manner, the pulse width is corrected so as to become greater than a reference pulse width corresponding to a gradation. It is assumed by way of example that reference pulse widths corresponding to the gradations D1 and D2 are PA and PB, respectively. In the case where the gradation changes from the gradation D1 to the gradation D2 in the fields from the field f2 over to the field f3, the pulse width of the voltage V1 to be applied to the pertinent pixel in the field f3 is set at PB×1.3 (=PB').

Besides, in a case where the display content changes from a field f5 over to a field f6, and where the gradation changes from the gradation D2 to the gradation D1, that is, the gradation of the screen changes in a lower direction, the pulse width is corrected so as to become smaller than the reference pulse width corresponding to the gradation. By way of example, in the case where the gradation changes from the gradation D2 to the gradation D1 in the fields from the field f5 over to the field f6, the pulse width of the voltage −V1 to be applied to the pertinent pixel in the field f6 is set at PA×0.7 (=PA').

In this way, even in the case where the display content changes and where the gradation of the screen changes, target gradations, namely, target transmission factors can be attained in all fields.

In this case, within the data conversion circuit 300 in FIG. 1, the difference of gradation data between the two fields of the gradation data read out of the field memory, which is currently under reading, and the gradation data read out of the field memory, in which the gradation data one field earlier is stored, is calculated every pixel, and the gradation data of the pertinent pixel, that is, the pulse width of a pulse voltage to be applied to the pertinent pixel in the later field is corrected in the changing direction of the gradation in accordance with the result of the calculation. In consequence, the time width of the part where the gradation has changed on the screen is corrected, and the pulse width of the voltage which is applied so as to be concentrated in the first half of the whole field is corrected so as to attain the target gradation (transmission factor).

With the electrooptic device relating to this embodiment, in the case where display content changes at the changeover of fields in the display of a dynamic picture image, the data conversion circuit 300 (control device) alters the pulse width of the pulse signal being of the ON voltage in the later field in accordance with the direction in which the brightness of the screen changes. Therefore, the response of the liquid crystal as the electrooptic material constituting each pixel can be improved so as to quickly attain a desired gradation in the direction in which screen brightness changes, and enhancement in picture quality can be achieved.

Further, in the electrooptic device relating to this embodiment, deterioration in a gradation characteristic attributed to the temperature change of the liquid crystal may be relieved in such a way that the pulse width of the pulse signal being of the ON voltage is altered in each field in accordance with the temperature of the liquid crystal itself being the electrooptic material or the ambient temperature of the liquid crystal.

This is incarnated in such a way that, in the embodiment already stated, the temperature of the liquid crystal itself or the ambient temperature of the liquid crystal is further detected by the temperature sensor being temperature detection means, whereupon the pulse width of the pulse signal being of the ON voltage as is predetermined in correspondence with a gradation is altered in each field on the basis of the detection output of the temperature sensor by the data conversion circuit being pulse width correction device.

More specifically, the optical response rate of the liquid crystal heightens when the temperature of the liquid crystal rises, whereas it lowers when the temperature of the liquid crystal lowers. In this embodiment, therefore, the output timing of the start pulse DY which stipulates a subfield period is altered so as to enlarge the pulse width of the pulse signal being of the ON voltage, namely, to enlarge the width of the subfield period which is the ON-voltage in a case where the temperature of the liquid crystal has become higher than a reference temperature, and so as to narrow the pulse width of the pulse signal being of the ON voltage, namely, to narrow the width of the subfield period which is the ON-voltage in a case where the temperature of the liquid crystal has become lower than the reference temperature.

The data conversion circuit 300 supplies the timing signal production circuit 200 with the control signal SC for making corrections so that the values of the data Ds1, Ds2, . . . Ds255 respectively corresponding to the subfields Sf1, Sf2, . . . , Sf255, which are inputted to the multiplexer 213 in the start pulse production circuit 210, may be altered on the basis of the detection output of the temperature sensor which detects the temperature of the liquid crystal itself or the ambient temperature of the liquid crystal.

As a result, the time widths of the individual subfields Sf1, Sf2, . . . , Sf255 are altered in accordance with the temperature change of the liquid crystal, namely, the response rate of the liquid crystal in one field In this manner, with the electrooptic device relating to this embodiment, the pulse width of the pulse signal being of the ON voltage is altered in each field in accordance with the temperature of the liquid crystal itself being the electrooptic material, or the ambient temperature of the liquid crystal. Therefore, even when the response rate of the liquid crystal being the electrooptic material has changed due to the temperature of the liquid crystal itself or the ambient temperature of the liquid crystal, the gradation characteristic of the liquid crystal can be held constant, and the deterioration of the gradation characteristic attributed to the temperature change can be relieved to achieve enhancement in picture quality.

Further, in the electrooptic device relating to this embodiment described above, the last subfield of each field can also be brought to a black display without fail. The reason therefor is as stated below. With the electrooptic device relating to the foregoing embodiment, a case can occur where all of the subfields Sf1, Sf2, . . . , Sf255 of the field are in ON voltage in accordance with gradation data. In such a case, there decreases to half the intended effect of this embodiment that, in order to enhance the reproducibility of a dynamic picture image, an electric field is removed from the liquid crystal layer at the earliest possible timing. An example for avoiding this problem will be described below.

In the above embodiment, one field is divided into the 255 subfields which are the subfields Sf1, Sf2, . . . , Sf255. Here in this example, one field is divided into 300 subfields which are subfields Sf1, Sf2, . . . , Sf300. The data conversion circuit 300 being control means performs control so that gradations may be displayed in the subfields Sf1, Sf2, . . . , Sf255 among the divisional subfields, as in the foregoing embodiment. On the other hand, it performs control so that the subfields Sf256–Sf300 may not contribute to an actual gradational display, but that they may be brought to the black display without fail. Alternatively, the data conversion circuit 300 performs control so that the subfields SF256–Sf300 may be combined into a single subfield which has a length corresponding to 46 subfields, and that the subfield which has the length corresponding to 46 subfields may be brought to the black display without fail.

As a result of such controls, the last subfield of the field can be brought to the black display. When the black displaying subfield is inserted into every field in this manner, even a gradation on the bright side is not continuously displayed, and the visibility of the dynamic picture image can be enhanced with ease.

Besides, the display mode of the electrooptic device of the foregoing embodiment has been explained as the normally-black mode. Even in a case where the display mode of the electrooptic device is the normally-white mode, the present invention is applicable to any construction which is similar to the construction described above. In that case, however, the signal states of the "ON voltage (ON state)" and the "OFF voltage (OFF state)" in the above description need to be replaced and controlled.

Figure 11:
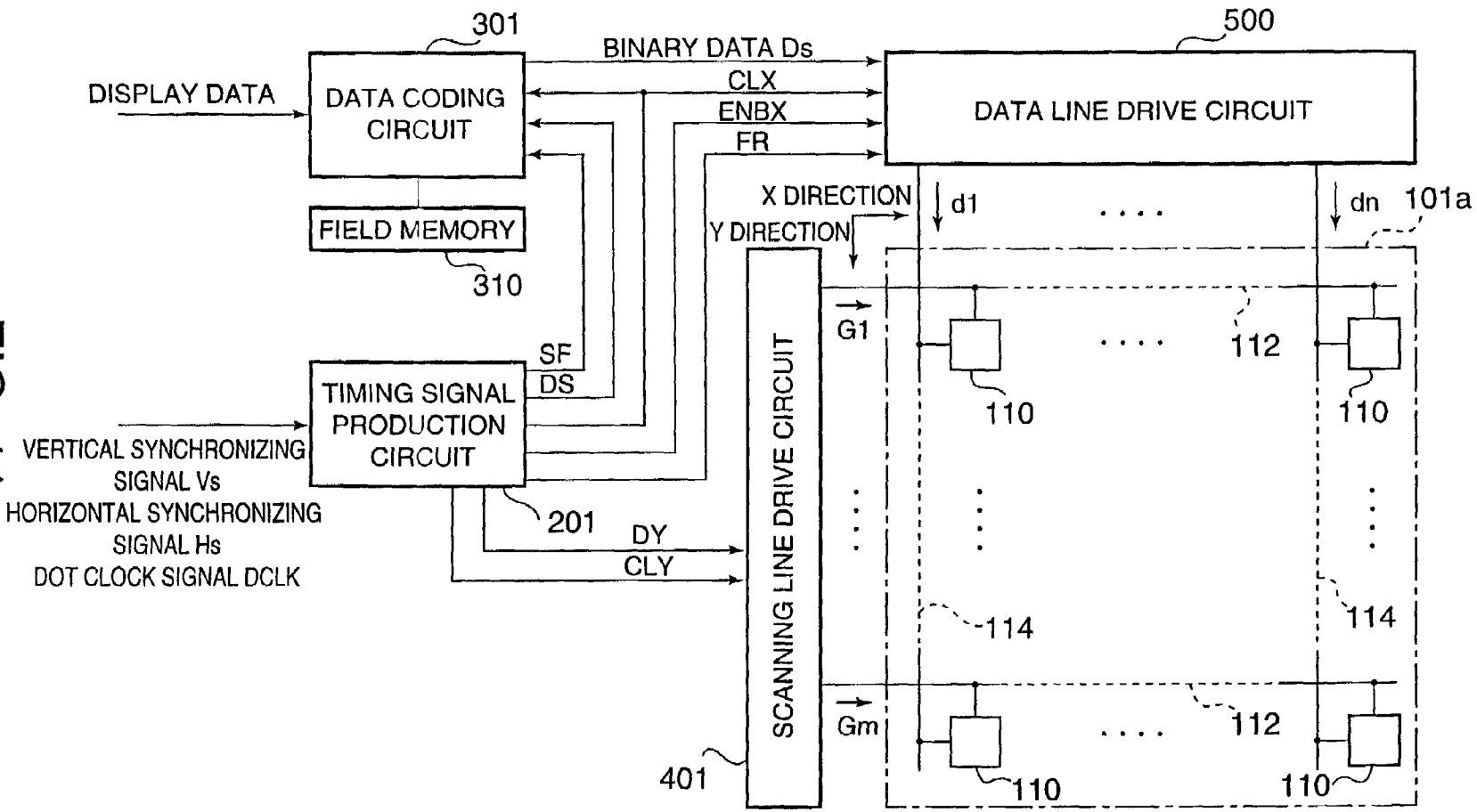
FIG. 11 is a block diagram showing an electrooptic device relating to the second embodiment of the present invention.

FIG. 11 is a block diagram showing an electrooptic device relating to the second embodiment of the present invention. In FIG. 11, the same reference numerals and signs are assigned to the same constituent elements as in FIG. 1, which shall be omitted from description.

In the first embodiment, the number of displayable gradations is limited by the number of divisional subfields. In contrast, this embodiment permits the number of displayable gradations to become sufficiently larger as compared with the number of divisional subfields.

Also in this embodiment, the subfield drive is adopted. This embodiment employs a plurality of subfields Sf1–Sf32 which are obtained by dividing one field period (1*f*) substantially equally as shown at (a) in FIG. 16.

In this embodiment, control is performed in correspondence with a gradation in each field so that subfields in ON states may be first concentrated in the first half of the field, and that at least one of the subfields may be brought into an OFF state, whereby gradations sufficiently larger in number than the subfields are displayed. That is, in a case where the gradation to be displayed can be displayed by utilizing N subfields from the start of the field, control is performed so that pulse signals each of which has a pulse width corresponding to the time period Ts of each subfield may be intermittently outputted within a time period (Ts×N) in which the N pulse signals are outputted from the start time of the field.

In this embodiment, pSiTFTs (poly-silicon TFTs), for example, shall be employed as devices for driving the electrooptic device. Besides, the number of subfields shall be 32 as mentioned above. This signifies that a scanning frequency in the prior-art drive scheme is 60 Hz, whereas a screen is scanned at a frequency which is 32 times higher (60×32 Hz), in this embodiment.

The electrical construction of the electrooptic device 100 in this embodiment is shown in FIG. 11. A practicable construction of each pixel 110 is the same as in FIG. 2(*a*). Incidentally, the pSiTFT is employed as a transistor 116 which is the switching device in FIG. 2(*a*).

By the way, also in this embodiment, a storage capacitance 119 is formed between a pixel electrode 118 and a counter electrode 108, but it may well be formed, e.g., between the pixel electrode 118 and a ground potential GND or between the pixel electrode 118 and a gate line. Besides, a wiring line having the same potential as a counter electrode voltage VLCCOM can be laid the side of an element substrate so as to form the storage capacitance between the pixel electrode and the wiring line.

A timing signal production circuit 201 produces a polarity inversion signal FR, a scanning start pulse DY, a scanning side transfer clock CLY, a data enable signal ENBX, a data transfer clock CLX, a data transfer start pulse DDS and a subfield identification signal SF in accordance with such timing signals as a vertical synchronizing signal Vs, a horizontal synchronizing signal Hs and a dot clock signal DCLK which are supplied from a host device (not shown). The functions of the respective signals will be explained below.

The polarity inversion signal FR is a signal whose polarity is inverted every field. The scanning start pulse DY is a pulse signal which is outputted at the beginning of each subfield, and a scanning line drive circuit 401 outputs a gate pulse (G1–Gm) when supplied with the pulse DY. The scanning side transfer clock CLY is a signal which stipulates the scanning speed of a scanning side (Y side), and the gate pulse is sent every scanning line in synchronism with this transfer clock. The data enable signal ENBX determines a timing at which data stored in an X shift register 510 included in a data line drive circuit 500 are concurrently outputted in the horizontal number of pixels. The data transfer clock CLX is a clock signal for transferring data to the data line drive circuit 500. The data transfer start pulse DDS stipulates a timing at which data transfer is started from a data coding circuit 301 to the data line drive circuit 500, and it is sent from the timing signal production circuit 201 to the data coding circuit 301. The subfield identification signal SF is for notifying the number of the pertinent pulse (subfield) in the sequence of the pulses (subfields) to the data coding circuit 301.

In the electrooptic device of this embodiment, data of H level or L level is written in order to bring each pixel into an ON state or OFF state in correspondence, with a gradation, in each of the subfields Sf1–Sf32. Data to be displayed is inputted as digital data of 8 bits from an external device (not shown) to the data coding circuit 301. In the data coding circuit 301, the 8-bit digital data are converted every subfield so as to be transferred to the data line drive circuit 500 as data binarized in conformity with predetermined rules. For this purpose, the data coding circuit 301 once accumulates the received data in a field memory 310 so as to execute the conversion process on occasion. When the data transfer start pulse DDS is inputted, the binarized display data is transferred to the data line drive circuit 500 in synchronism with the data transfer clock CLX.

Here, in binarizing the display data, the data coding circuit 301 needs to recognize which of the subfields in one field the display data belongs to. In this embodiment, the number of the scanning start pulses DY is counted by the timing signal production circuit 201, and the count result is outputted toward the data coding circuit 301 as the subfield identification signal SF. The measurement of the scanning start pulses DY is done from 0 to 31, and it is reset by the vertical synchronizing signal externally inputted. The data coding circuit 301 recognizes the subfield with the subfield identification signal SF.

As stated before, the data coding circuit 301 realizes a gradation designated for each pixel, in such a way that, in accordance with the gradation to be displayed, the pulse signals being of the ON voltage are basically outputted so as to be concentrated in the first half of each field, whereupon at least one of the ON-voltage pulse signals concentrated in the first half is turned into the OFF voltage.

Further, the field memory 310 of the data coding circuit 301 is endowed with a capacity which is adapted to store display data corresponding to two fields. Here, the first constituent field memory is a memory into which the display data being externally inputted are written, and the second constituent field memory is a memory in which the display data having been inputted one field earlier are stored. The field memory 310 is such that, while the display data being externally inputted are being written into the first constituent field memory, the data coding circuit 301 accesses the second constituent field memory so as to read out the display data of each pixel. The roles of the first constituent field memory and the second constituent field memory are exchanged every field.

Figure 16:
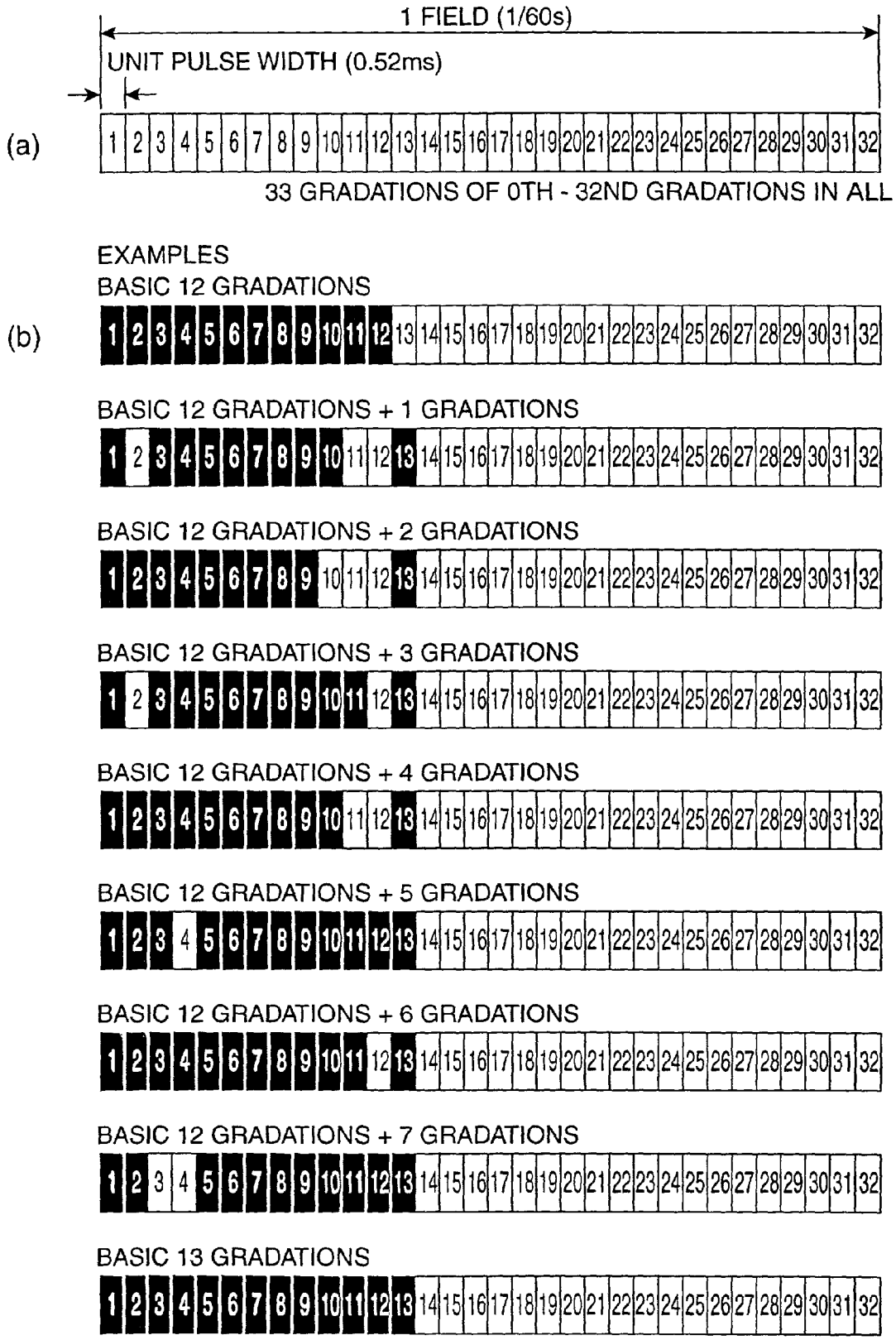
FIG. 16 is a timing chart showing the white display periods of the subfields in the second embodiment.

Examples of control of the subfields in the data coding circuit 301 are shown at (b) in FIG. 16. In this figure, a black part indicates the subfield of the ON voltage as is brought to a white display. With control in which the subfields for presenting the white display are concentrated in the first half of the field as explained in the first embodiment, the only displayable gradations are the 33 gradations of the 0th–32nd in the case where one field is divided into the 32 subfields as in this embodiment. Here, the gradations (brightnesses) which can be displayed by the method explained in the first embodiment shall be termed, for example, "basic 12 gradations", while the gradations (brightnesses) which can be displayed by the control of this embodiment shall be termed, for example, "basic 12 gradations+1 gradation".

By way of example, in the case of displaying the gradation of "basic 12 gradations+2 gradations", data signals indicating ON states are outputted in the intervals of the subfields Sf1–Sf9 and Sf13, and data signals indicating OFF states are outputted in the subfields Sf10–Sfl2 and Sfl4–Sf32, as shown at (b) in FIG. 16. Besides, in the case of displaying the gradation of "basic 12 gradations+5 gradations", data signals indicating ON states are outputted in the intervals of the subfields Sf1–Sf3 and Sf5–Sf13, and data signals indicating OFF states are outputted in the subfields Sf4 and Sfl4–Sf32, as shown at (b) in FIG. 16.

Figure 13:
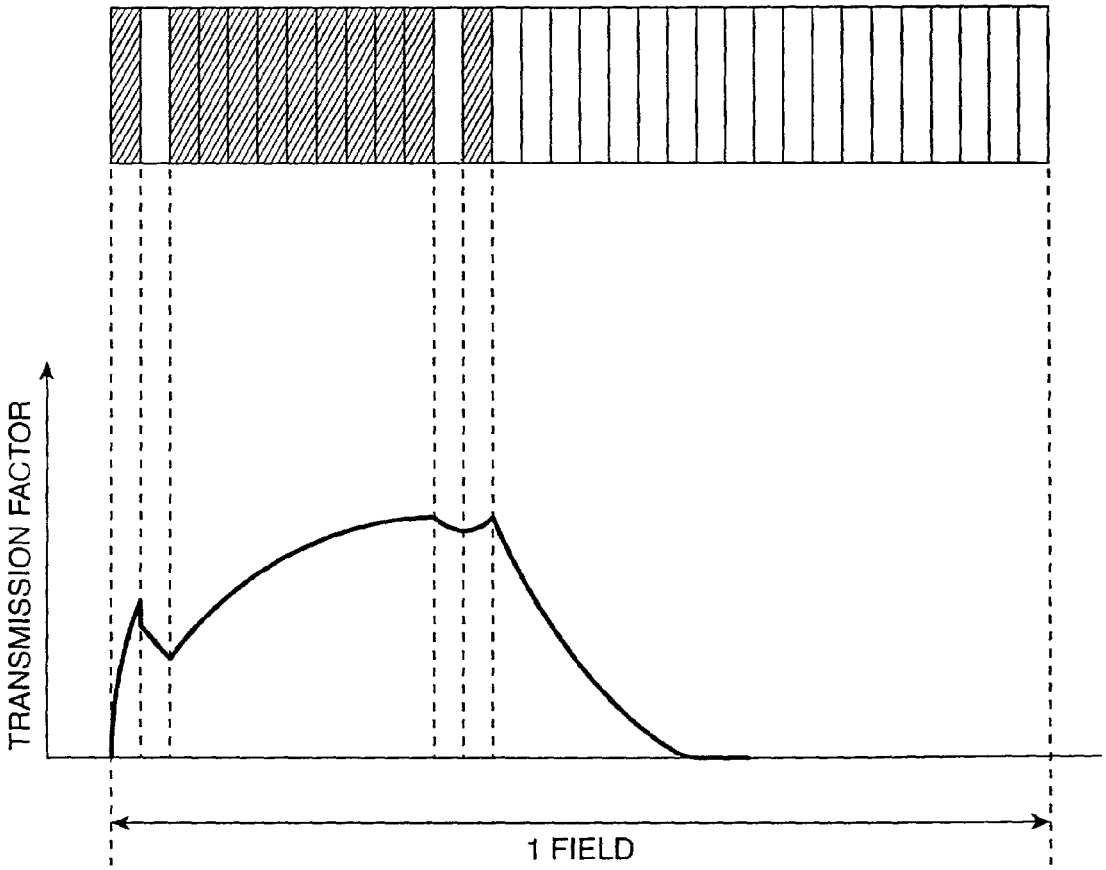
FIG. 13 is a diagram showing the transmission factor of a liquid crystal in the case where subfields are controlled as shown in FIG. 16, in the second embodiment.

FIG. 13 shows the transmission factor of a liquid crystal in the case where, in this embodiment, control is performed as indicated by "basic 12 gradations+3 gradations" at (b) in FIG. 16. As shown in FIG. 13, at least one of the subfields presenting the white display is turned into the OFF voltage, whereby the transmission factor declines. As a result, the integral value of the transmission factor that indicates brightness becomes smaller than in a case where at least one of the subfields presenting the white display is not turned into the OFF voltage. The number of gradations can be increased by such a principle.

Referring to FIG. 11, the scanning line drive circuit 401 transfers the scanning start pulse DY supplied at the beginning of each subfield, in accordance with the scanning side transfer clock CLY, so as to sequentially and exclusively supply the scanning signals G1, G2, G3, . . . , Gm to respective scanning lines 112.

The data line drive circuit 500 sequentially latches binary data in a number n corresponding to the number of data lines, in a certain horizontal scanning period, whereupon it simultaneously supplies the n latched binary data as data signals d1, d2, d3, . . . , dn to the respectively corresponding data lines 114 in the next horizontal scanning period.

Here, a practicable construction of the data line drive circuit 500 will be described with reference to FIG. 14. The data line drive circuit 500 is constructed of an X shift register 510, a first latch circuit 520 and a second latch circuit 530 each of which corresponds to the horizontal number of pixels, and a booster circuit 540 which corresponds to the horizontal number of pixels.

Of them, the X shift register 510 transfers the data enable signal ENBX supplied at the start timing of the horizontal scanning period, in accordance with the clock signal CLX, so as to sequentially and exclusively supply latch signals S1, S2, S3, . . . , Sn. Next, the first latch circuit 520 sequentially latches the binary data at the falls of the latch signals S1, S2, S3, . . . , Sn. Besides, the second latch circuit 530 simultaneously latches the respective binary data latched by the first latch circuit 520, at the fall of the data enable signal ENBX, and it supplies the latched data to the respective data lines 114 through the booster circuit 540 as the data signals d1, d2, d3, . . . , dn.

Figure 12:
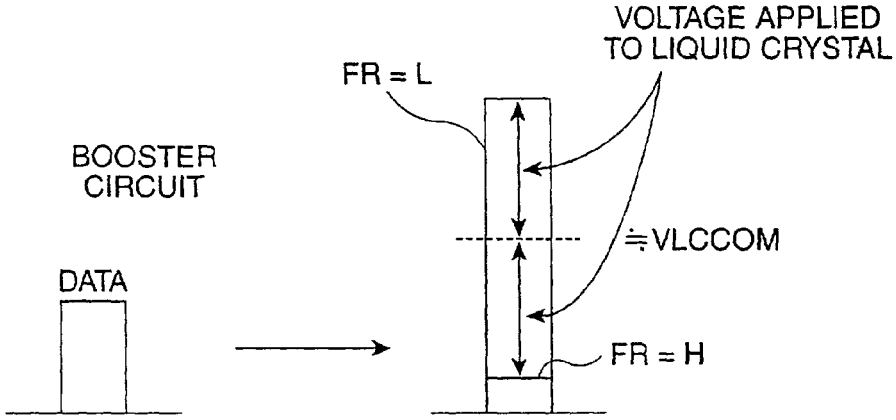
FIG. 12 is a diagram for explaining the operation of a booster circuit 540 in the second embodiment.

The booster circuit 540 is endowed with a polarity inversion function and a boost function. This booster circuit 540 boosts its inputs on the basis of the polarity inversion signal FR. A diagram for explaining the operation of the booster circuit 540 is shown in FIG. 12. By way of example, in a case where a data signal for bringing a certain pixel into an ON state has been inputted to the booster circuit 540 under the condition of the L level of the polarity inversion signal FR, this booster circuit outputs a plus liquid-crystal drive voltage. Besides, in a case where a data signal for bringing a certain pixel into an ON state has been inputted under the condition of the H level of the polarity inversion signal FR, the booster circuit 540 outputs a minus liquid-crystal drive voltage. In the case of data for bringing a pixel into an OFF state, the booster circuit 540 outputs the potential VLCCOM irrespective of the state of the polarity inversion signal FR.

Figure 15:
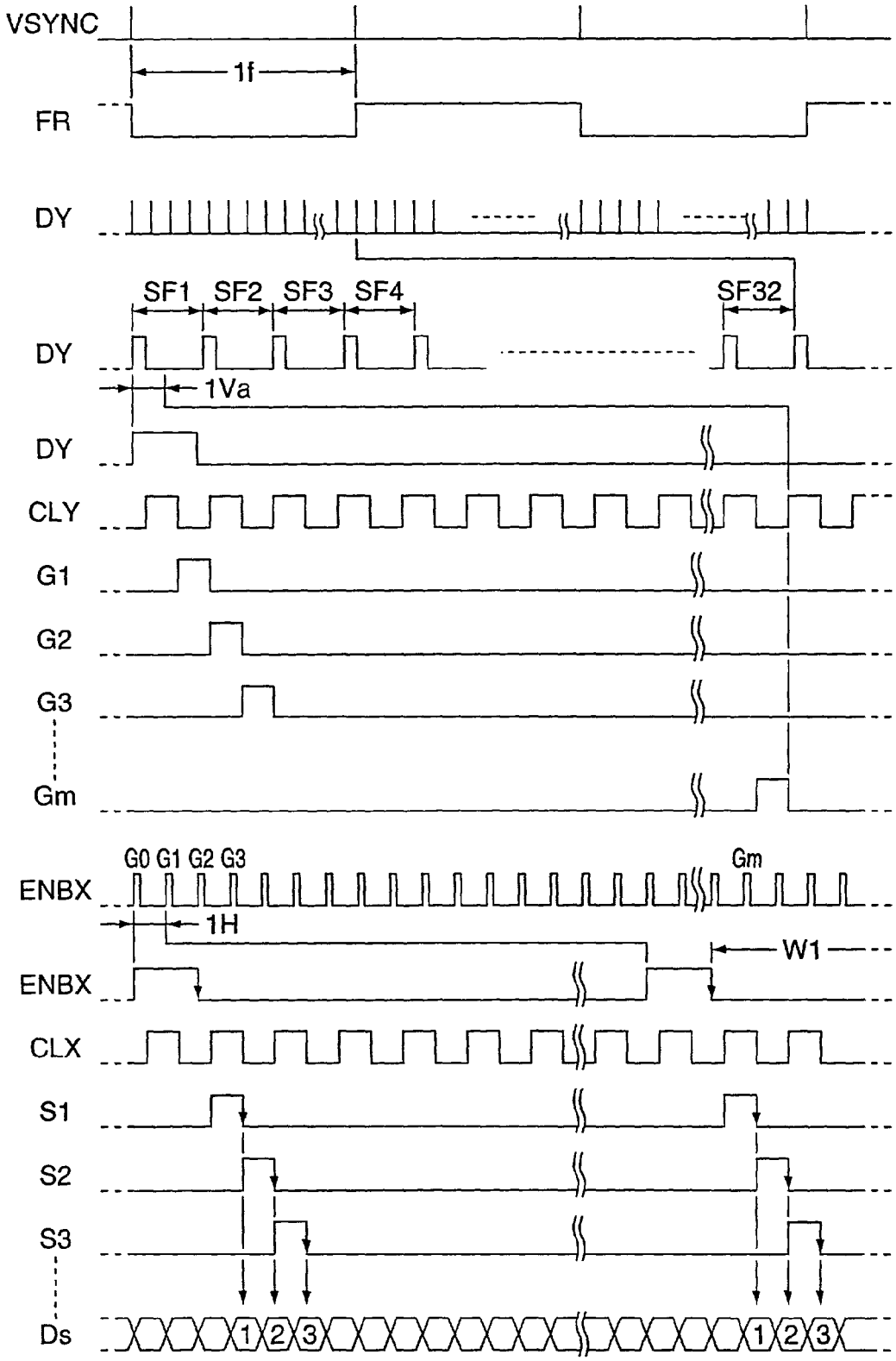
FIG. 15 is a timing chart for explaining the operation of the electrooptic device relating to the second embodiment.

Next, the operation of the electrooptic device relating to the second embodiment will be described. FIG. 15 is a timing chart for explaining the operation of this electrooptic device.

First, the polarity inversion signal FR is the signal whose level is inverted every field period (1*f*). On the other hand, the scanning start pulse DY is supplied at the start of each of the subfields Sf1–Sf32.

Here, when the scanning start pulse DY is supplied in the field period (if) in which the polarity inversion signal FR is at the L level, the scanning signals G1, G2, G3, . . . , Gm are sequentially and exclusively outputted in a time period (t) by transfers according to the scanning side transfer clock CLY in the scanning line drive circuit 401. By the way, in this embodiment, one field is equally divided by 32 as stated above, so that the individual subfields have equal time widths.

Each of the scanning signals G1, G2, G3, . . . , Gm has a pulse width equal to a half cycle of the scanning side transfer clock CLY. Besides, the scanning signal G1 which corresponds to the first scanning line 112 as determined from above is outputted with a delay of, at least, the half cycle of the scanning side transfer clock CLY after the first rise of the scanning side transfer clock CLY after the scanning start pulse DY has been supplied. Accordingly, the first clock pulse (G0) of the data enable signal ENBX is supplied to the data line drive circuit 500 in a time interval after the supply of the scanning start pulse DY and before the output of the scanning signal G1.

First, there will be explained a case where the first clock pulse (G0) of the data enable signal ENBX has been supplied. When one clock pulse (G0) of the data enable signal ENBX has been supplied to the data line drive circuit 500, the latch signals S1, S2, S3, . . . , Sn are sequentially and exclusively outputted in the horizontal scanning period (1 H) by the transfers according to the data transfer clock CLX. Incidentally, each of the latch signals S1, S2, S3, . . . , Sn has a pulse width equal to a half cycle of the data transfer clock CLX.

Figure 14:
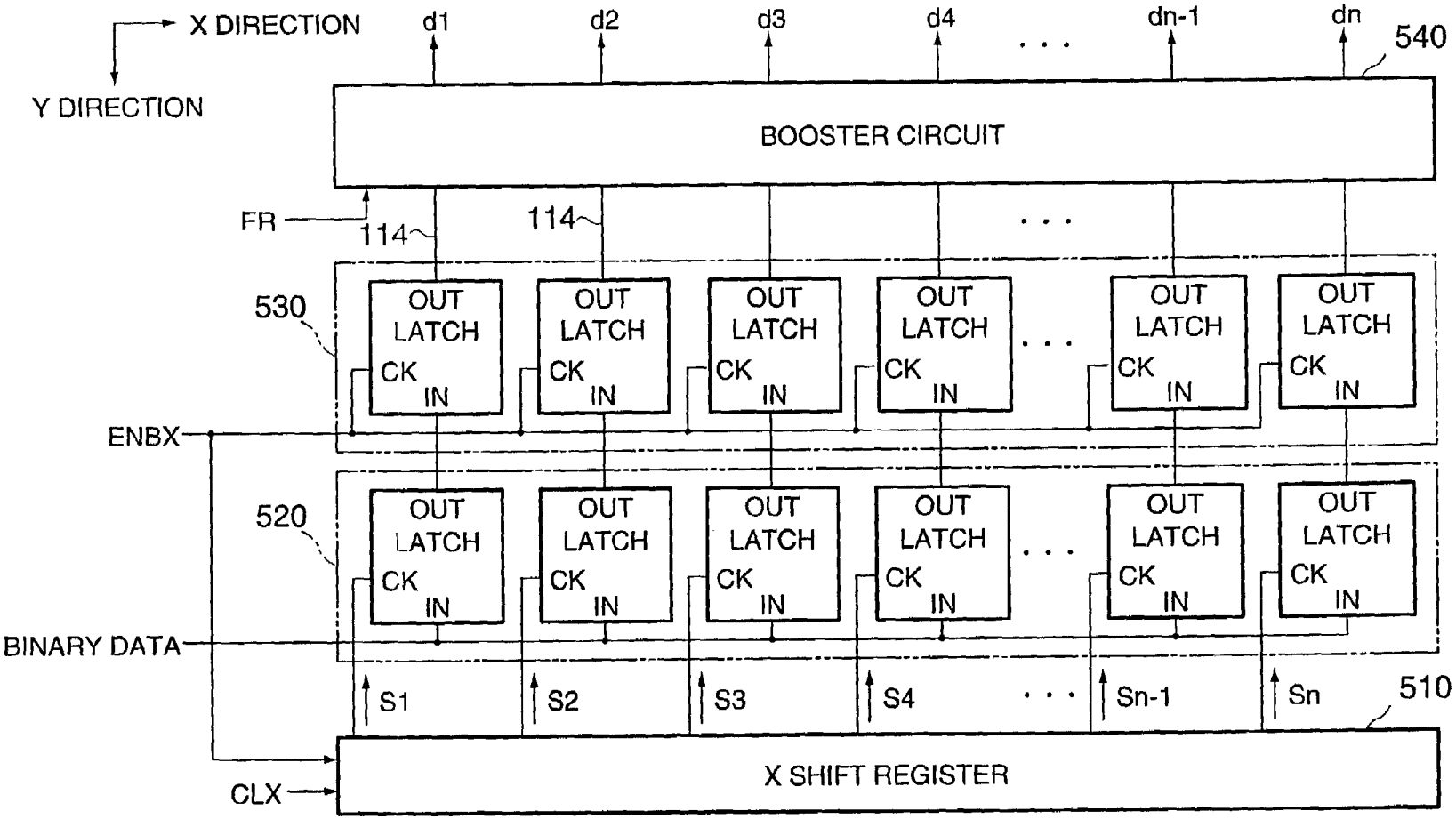
FIG. 14 is a diagram for explaining the construction of a data line drive circuit 500 in the second embodiment.

On this occasion, the first latch circuit 520 in FIG. 14 latches the binary data for the pixel 10 which corresponds to the intersection between the first scanning line 112 as determined from above and the first data line 114 as determined from the left, at the fall of the latch signal S1. Subsequently, it latches the binary data for the pixel 110 which corresponds to the intersection between the first scanning line 112 as reckoned from above and the second data line 114 as reckoned from the left, at the fall of the latch signal S2. Thenceforth, it similarly latches the binary data for the pixel 110 which corresponds to the intersection between the first scanning line 112 as reckoned from above and the nth data line 114 as reckoned from the left.

Thus, first of all, the binary data for the pixels of one row which correspond to the intersections with the first scanning line 112 from above in FIG. 11 are point-sequentially latched by the first latch circuit 520. It is needless to say that the data coding circuit 301 sequentially produces the binary data corresponding to the individual subfields, from the display data of the respective pixels, and then outputs the produced signals, in conformity with the timings of the latches of the first latch circuit 520.

Subsequently, when the clock signal CLY has fallen to output the scanning signal G1, the first scanning line 112 as determined from above in FIG. 11 is selected, with the result that all the transistors 116 of the pixels 110 corresponding to the intersections with the pertinent scanning line 112 turn ON.

On the other hand, the data enable signal ENBX (G1) is outputted again at the fall timing of the pertinent clock signal CLY. Besides, at the rise timing of the data enable signal, the second latch circuit 530 simultaneously supplies the binary data latched point-sequentially by the first latch circuit 520, as the data signals d1, d2, d3, . . . , dn to the respectively corresponding data lines 114 through the booster circuit 540. Thus, the data signals d1, d2, d3, . . . , dn are simultaneously written into the pixels 110 of the first row as determined from above.

Concurrently with the writing, the binary data of one row of pixels which correspond to the intersections with the second scanning line 112 from above in FIG. 11 are latched point-sequentially by the first latch circuit 520.

In this manner, with the electrooptic device relating to this embodiment, in bringing each of a plurality of pixels to a gradational display, control is performed by the data coding circuit 301 so that pulse signals being of an ON voltage to be applied to each of the plurality of pixels may be concentrated in the first half of a field, and that at least one of the pulse signals being of the ON voltage may be outputted as an OFF voltage in correspondence with a gradation to be displayed.

Similar operations are repeated until the scanning signal Gm corresponding to the mth scanning line 112 is outputted. Incidentally, the data signals written into the pixels 110 are retained till writing in the next subfield Sf2.

Thereafter, similar operations are repeated each time the scanning start pulse DY stipulating the start of each subfield is supplied.

Figure 17:
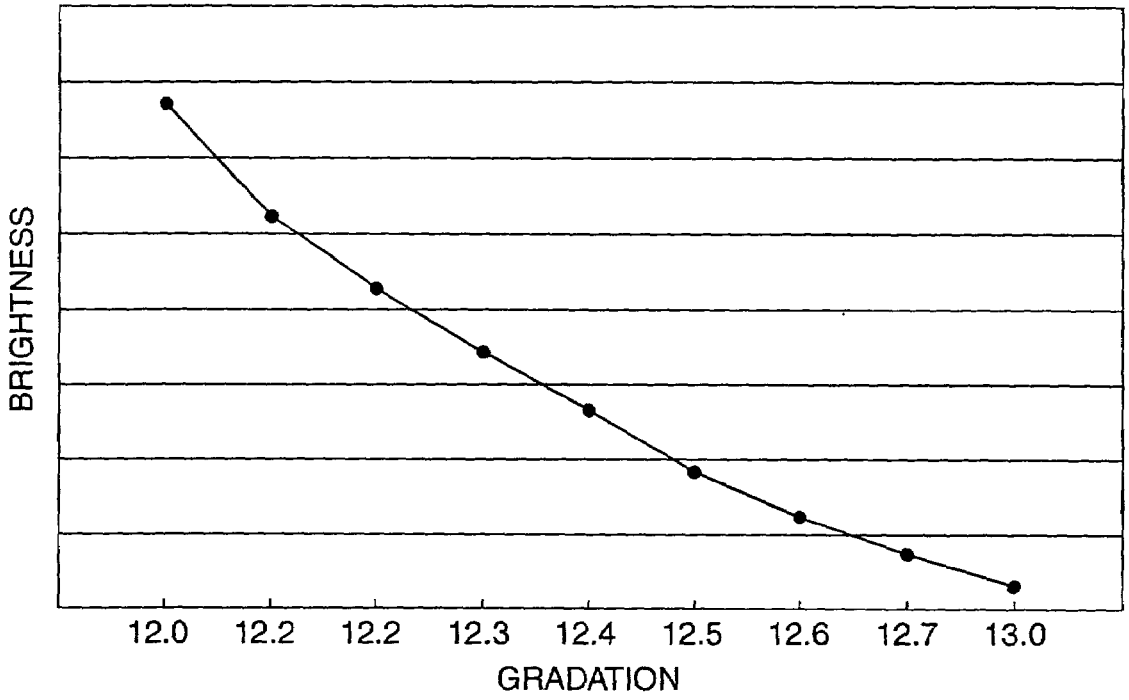
FIG. 17 is a graph showing the brightness of a pixel in the case where the subfields are controlled as shown in FIG. 16, in the second embodiment.

Shown in FIG. 17 are the experimental data of the brightness of the electrooptic device employing the pSiTFTs, in the case where in the above construction, the subfields are brought to the white display as exemplified at (b) in FIG. 16. Incidentally, in FIG. 17, by way of example, "12_0" on the axis of abscissas denotes the "basic 12 gradations" at (b) in FIG. 16, and "12_5" denotes the "basic 12 gradations+5 gradations" at (b) in FIG. 16. It is understood from the experimental result of FIG. 17 that seven gradations can be displayed between the basic 12 gradations (brightnesses) and the basic 13 gradations (brightnesses) by driving the liquid crystal as exemplified at (b) in FIG. 16.

Incidentally, only the examples of patterns for attaining the gradations which interpolate between the gradation for the white display of the subfields Sf1–Sfl2 and the gradation for the white display of the subfields Sf1–Sf13 have been shown here. Even in the case of interpolating between other gradations, however, gradations between subfields M and (M+1) can be displayed by controlling the subfields in the same manner as at (b) in FIG. 16.

Here, in the case of displaying the gradations between the subfields M and (M+1), a gradation closer to the Mth gradation can be attained in such a way that, of the ON pulses (subfields) successively arranged for presenting the white display, the pulse (subfield) in the vicinity of the start of the white display, except the white display starting pulse, is turned OFF. Incidentally, the "vicinity of the start of the white display" termed here signifies that time period from the start of the application of the white display signal based on the changeover of fields, which is shorter than the optical response time of the display element (in this embodiment, the liquid crystal), that is, in which the transition process of response is proceeding.

Also, a gradation closer to the Mth gradation can be attained in such a way that, of the ON pulses (subfields) successively arranged for presenting the white display, the pulse (subfield) in the vicinity of the end of the white display, except the white display ending pulse, is turned OFF. Incidentally, the "vicinity of the end of the white display" termed here signifies a time period which traces back the optical response time of the display element (in this embodiment, the liquid crystal) from the time point when the white display is ended in the case of displaying the (M+1)th gradation.

A gradation closer to the (M+1)th gradation can be attained by turning OFF any other pulse.

A necessary gradation can be attained by selecting a suitable combination from the above gradations.

Besides, although the drive device has been assumed to be a pSiTFT in the foregoing embodiment, the present invention is not restricted thereto. It should be understood that the present invention is applicable in a case where the display element (corresponding to the liquid crystal in the foregoing embodiment) of an electrooptic device having a construction similar to the above construction exhibits an optical response time longer than the time period of one subfield or exhibits an optical response characteristic close thereto. Such electrical engineering devices include, for example, a projector which includes a liquid-crystal light valve utilizing a pSiTFT as a drive device, and a direct view type liquid-crystal display device (direct view type LCD) which employs an αTFT or a TFD as a drive device. These constructions will be described in greater detail below.

Here, it will be verified if the display element of the electrooptic device applied in this embodiment has the optical response characteristic stated above.

In the foregoing embodiment, one field is divided into the 32 drive pulses (subfields) at the frame frequency of 60 Hz. The length of a unit pulse and the response rate of the liquid crystal in this case will be compared.

Unit pulse=1÷60÷32=about 0.5 (msec)

Response rate of Liquid crystal (Typical value of TN liquid crystal)=approximately 5 (msec)

In this manner, the unit pulse time in this embodiment is sufficiently shorter relative to the response rate of the liquid crystal, so that the electrooptic device of this embodiment is effective.

Besides, the display mode of the electrooptic device of the foregoing embodiment has been described as the normally-black mode. Even in a case where the display mode of the electrooptic device is the normally-white-mode, the present invention is applicable to any construction which is similar to the construction described above. In that case, however, the signals of the "ON voltage (ON state)" and the "OFF voltage (OFF state)" in the above description need to be replaced and controlled.

Figure 18:
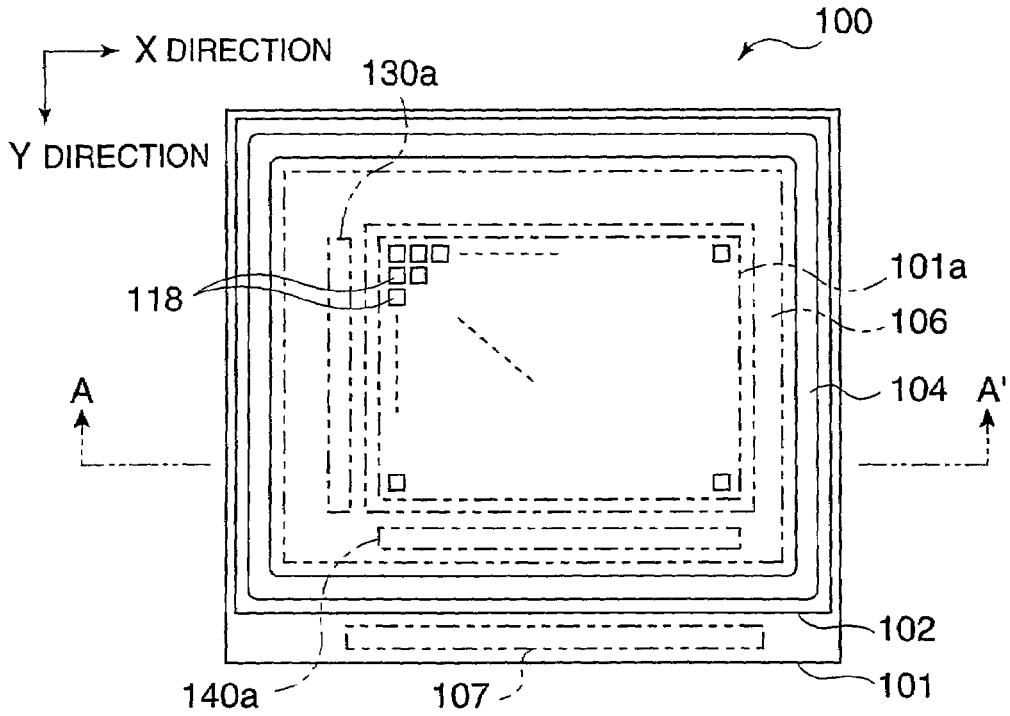
FIG. 18 is a plan view showing the construction of an electrooptic device 100.
Figure 19:
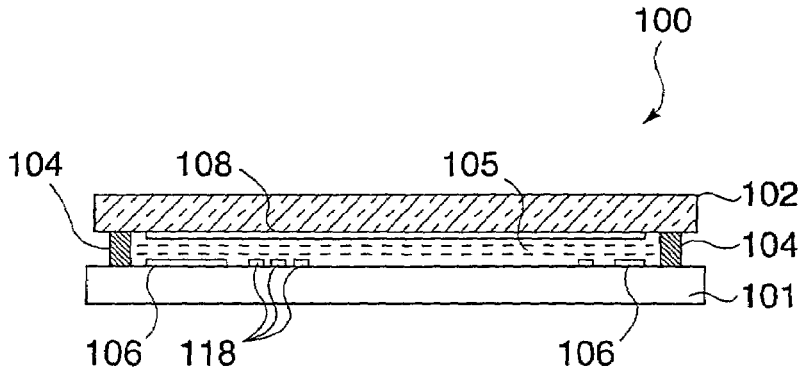
FIG. 19 is a sectional view taken along line A–A' in FIG. 18.

Next, the structure of the electrooptic device relating to each of the foregoing embodiments and applications will be described with reference to FIGS. 18 and 19. Here, FIG. 18 is a plan view showing the construction of an electrooptic device 100, while FIG. 19 is a sectional view taken along line A–A' in FIG. 18.

As shown in these figures, the electrooptic device 100 has such a structure that an element substrate 101 formed with pixel electrodes 118 etc., and an opposing substrate 102 formed with a counter electrode 108 etc. are stuck to each other with a predetermined gap defined therebetween by a sealing member 104, and that a liquid crystal 105 being an electrooptic material is enclosed in the gap. By the way, in actuality, the sealing member 104 has a notched part, and the liquid crystal 105 is sealed by a sealant after having been introduced through the notched part. Such an actual situation is omitted from these figures.

The liquid-crystal display device of the normally-black display mode as in this embodiment can be fabricated, for example, in such a way that a liquid crystal panel is constructed by combining a vertical orientation film and a liquid crystal material of negative dielectric anisotropy, and that the film and the material are sandwiched in between two polarizer plates which are arranged with their transmission axes shifted 90 degrees from each other.

Of course, it is possible to employ a TN-mode liquid crystal of normally-white display mode. In that case, the liquid crystal may be driven so as to bring a voltage into an OFF state in a subfield for a white display, and to bring a voltage into an ON state in a subfield for a black display.

The opposing substrate 102 is a transparent substrate which is made of glass or the like. Besides, although the element substrate 101 has been described above to be made of a transparent substrate, it can also be made of a semiconductor substrate in the case of an electrooptic device of reflection type. In this case, the semiconductor substrate is opaque, so that the pixel electrodes 118 are formed of a reflective metal such as aluminum.

In the element substrate 101, a light shield film 106 is disposed on an area which lies inside the sealing member 104 and outside a display area 101*a*. In the area where the light shield film 106 is formed, a scanning line drive circuit 130 is formed on an area 130*a*, and a data line drive circuit 140 is formed on an area 140*a*.

More specifically, the light shield film 106 prevents light from entering the drive circuits formed on this area. A counter electrode voltage VLCCOM is applied to the light shield film 106, simultaneously to the counter electrode 108.

Besides, in the element substrate 101, a plurality of connection terminals are formed on an area 107 which lies outside the area 140*a* formed with the data line drive circuit 140, so as to hold the sealing member 104 between this area 107 and the area 140*a*, whereby control signals, power supply voltages etc. are externally inputted.

On the other hand, the counter electrode 108 of the opposing substrate 102 is electrically conducted with the light shield film 106 and the connection terminals in the element substrate 101, by a conductive member (not shown) which is disposed at, at least, one of the four corners of the portion where the substrates stick together. That is, the counter electrode voltage VLCCOM is applied to the light shield film 106 through the connection terminal disposed in the element substrate 101, and further to the counter electrode 108 through the conductive member.

Besides, in accordance with the intended use of the electrooptic device 100, for example, for a direct view type, the opposing substrate 102 is first provided with color filters which are arrayed in the shape of stripes, a mosaic, triangles or the like, and it is secondly provided with light shield films (black matrix) which are made of, for example, a metal material or a resin. Incidentally, the color filters are not formed in a case where the electrooptic device is used for colored-light modulation, for example, where it is used as the light valve of a projector as will be described later. Besides, in the case of the direct view type, the electrooptic device 100 is provided with an illuminator which throws light from the side of the opposing substrate 102 or the side of the element substrate, as may be needed. In addition, orientation films or the like (not shown) each having been subjected to rubbing in a predetermined direction are disposed between the electrodes formed in the element substrate 101 and the opposing substrate 102, thereby to stipulate the oriented direction of liquid crystal molecules in a state where no voltage is applied, while a polarizer (not shown) conforming to the oriented direction is disposed on the side of the opposing substrate 102. However, when a high-polymer dispersion type liquid crystal which is dispersed in the form of granules in a high polymer is employed as the liquid crystal 105, the orientation films, polarizer etc. mentioned above are dispensed with, resulting in a higher light utilization efficiency, and hence, the employment of the liquid crystal is advantageous in such points as heightening luminance and lowering power dissipation.

Next, several examples in which the liquid crystal devices stated above are applied to practicable electronic equipment will be described.

Figure 20:
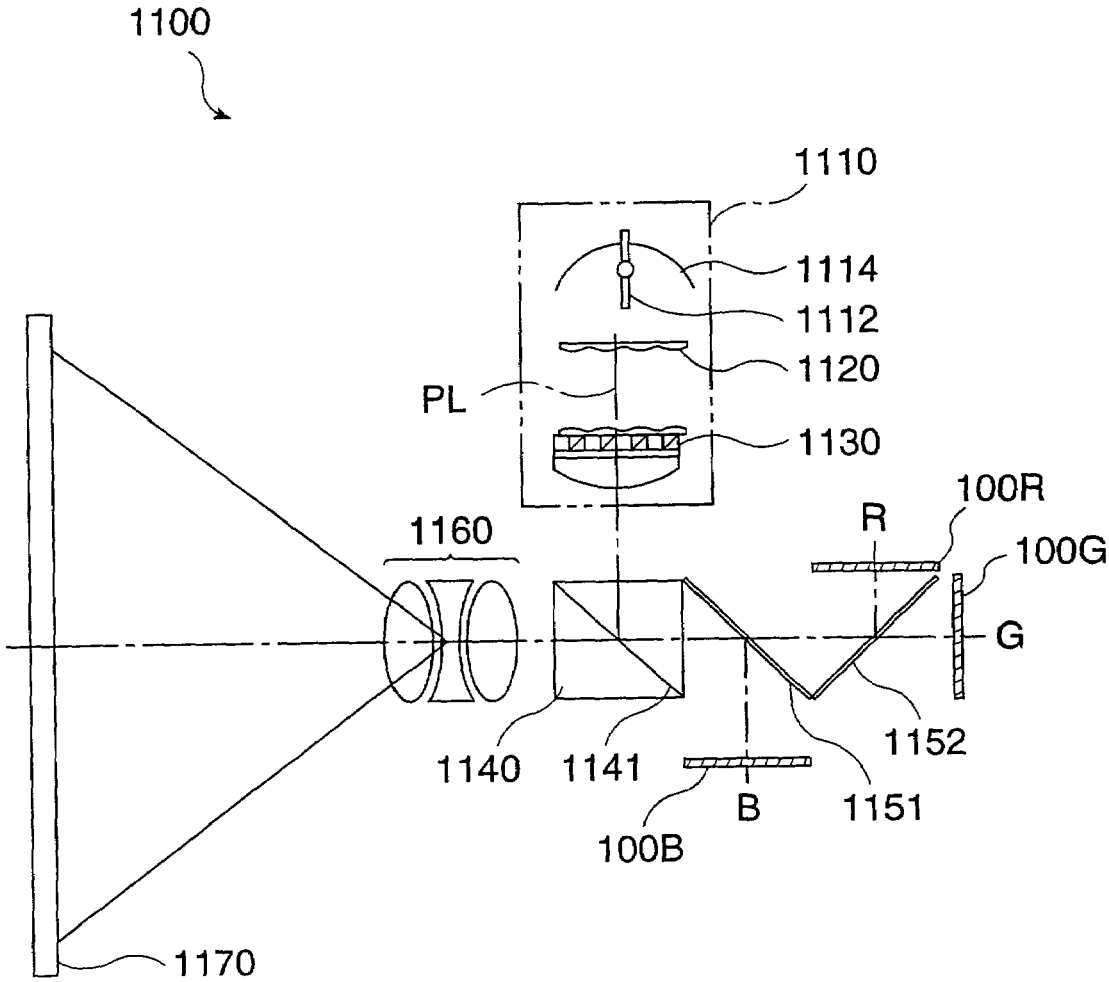
FIG. 20 is a sectional view showing the construction of a projector which is an example of an electronic equipment that applies electrooptic devices relating to an embodiment of the present invention.

First, there will be described a projector in which electrooptic devices relating to an embodiment are employed as light valves. FIG. 20 is a plan view showing the construction of the projector. As shown in this figure, a polarized-light illumination device 1.110 is arranged along a system optic axis PL inside the projector 1100. In the polarized-light illumination device 1110, light emitted from a lamp 1112 is reflected by a reflector 114 into substantially parallel light fluxes, which enter a first integrator lens 1120. Thus, the emitted light from the lamp 1112 is divided into a plurality of intermediate light fluxes. The divisional intermediate light fluxes are transduced into one sort of polarized light fluxes (s-polarized light fluxes) of substantially uniform polarized directions by a polarized-light transducer 1130 which has a second integrator lens on its light entrance side. The s-polarized light fluxes are emitted from the polarized-light illumination device 1110.

The s-polarized light fluxes emitted from the polarized-light illumination device 1110 are reflected by the s-polarized light flux reflecting face 1141 of a polarization beam splitter 1140. Of the reflected light fluxes, the light flux of blue light (B) is reflected by the blue light reflecting layer of a dichroic mirror 1151, and the reflected light flux is modulated by the electrooptic device 100B of reflection type. Besides, of the light fluxes transmitted through the blue light reflecting layer of the dichroic mirror 1151, the light flux of red light (R) is reflected by the red light reflecting layer of a dichroic mirror 1152, and the reflected light flux is modulated by the liquid electrooptic device 100G of reflection type.

On the other hand, of the light fluxes transmitted through the blue light reflecting layer of the dichroic mirror 1151, the light flux of green light (G) is transmitted through the red light reflecting layer of the dichroic mirror 1152, and the transmitted light flux is modulated by the liquid electrooptic device 100G of reflection type.

The red, green and blue lights respectively subjected to the colored-light modulations by the electrooptic devices 100R, 100G, 100B in this manner, are successively combined by the dichroic mirrors 1152, 1151 and the polarization beam splitter 1140, and the resultant light is thereafter projected on a screen 1170 by a projecting optical system 1160. Incidentally, the light fluxes corresponding to the primary colors R, G, B are caused to enter the electrooptic devices 100R, 100B and 100G by the dichroic mirrors 1151, 1152, so that color filters are not required.

Incidentally, although the electrooptic devices of reflection type have been employed in this embodiment, a projector may well employ electrooptic devices of transmission type display.

Figure 21:
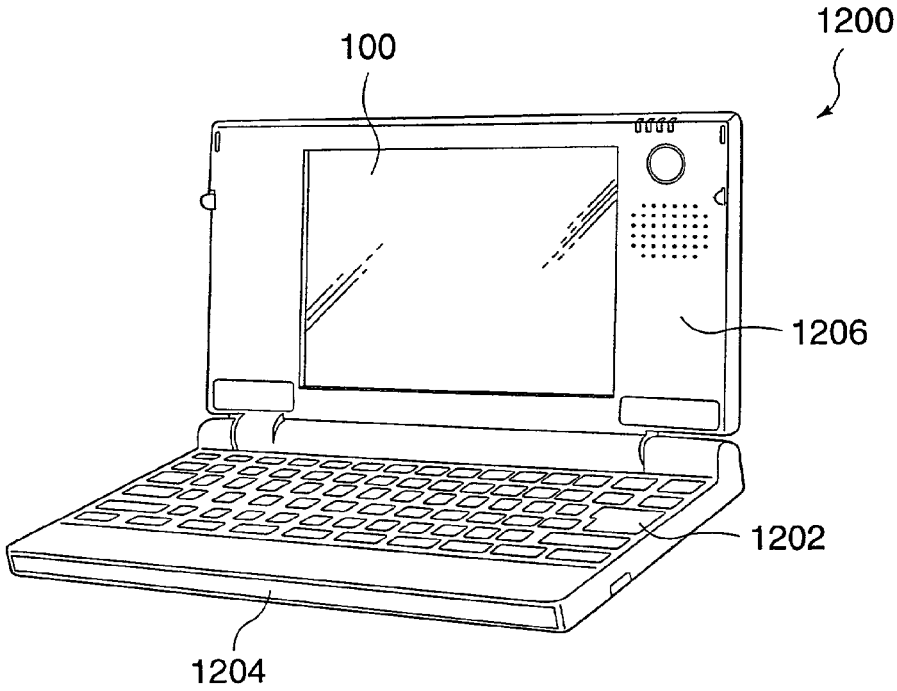
FIG. 21 is a perspective view showing the construction of a personal computer which is an example of an electronic equipment that applies an electrooptic device relating to an embodiment of the present invention.

Next, there will be described an example in which the electrooptic device is applied to a personal computer of mobile type. FIG. 21 is a perspective view showing the construction of the personal computer. Referring to the figure, the computer 1200 is constructed of a body portion 1204 including a keyboard 1202, and a display portion 1206. The display portion 1206 is constructed by adding a front light to the front face of the electrooptic device 100 stated before.

Incidentally, with this construction, the electrooptic device 100 is employed as a reflection direct-view type. Therefore, each pixel electrode 118 should desirably be formed with ruggedness so that reflected light may be scattered in various directions.

Figure 22:
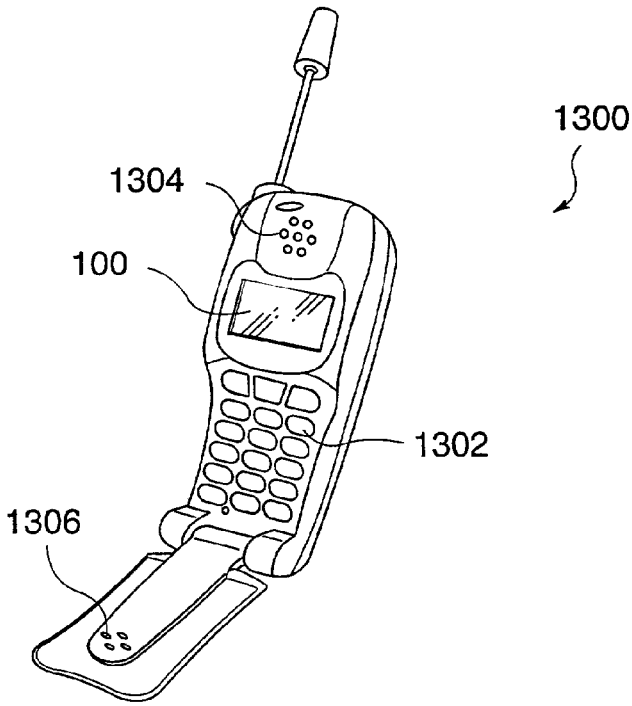
FIG. 22 is a perspective view showing the construction of a portable telephone which is an example of an electronic equipment that applies an electrooptic device relating to an embodiment of the present invention.

Further, there will be described an example in which the electrooptic device is applied to a portable telephone. FIG. 22 is a perspective view showing the construction of the portable telephone. Referring to the figure, the portable telephone 1300 includes a receiver mouthpiece 1304 as well as a transmitter mouthpiece 1306 and the electrooptic device 100, in addition to a plurality of operation buttons 1302.

This electrooptic device 100 is also provided with a front light at its front face as may be needed. Besides, with this construction, the electrooptic device 100 is employed as the reflection direct-view type, so that each pixel electrode 18 should desirably be formed with ruggedness.

Incidentally, it should be understood that other electronic equipment that can be mentioned in addition to those described with reference to FIGS. 21 and 22 can include a liquid-crystal television set, video tape recorders of view finder type and monitor direct-view type, a car navigation system, a pager, an electronic notebook, an electronic calculator, a word processor, a workstation, a video telephone, a POS terminal, an equipment furnished with a touch panel, and the like. In this regard, it is needless to say that the electrooptic devices relating to the respective embodiments and applications are applicable to the various electronic equipment.

Figure 23:
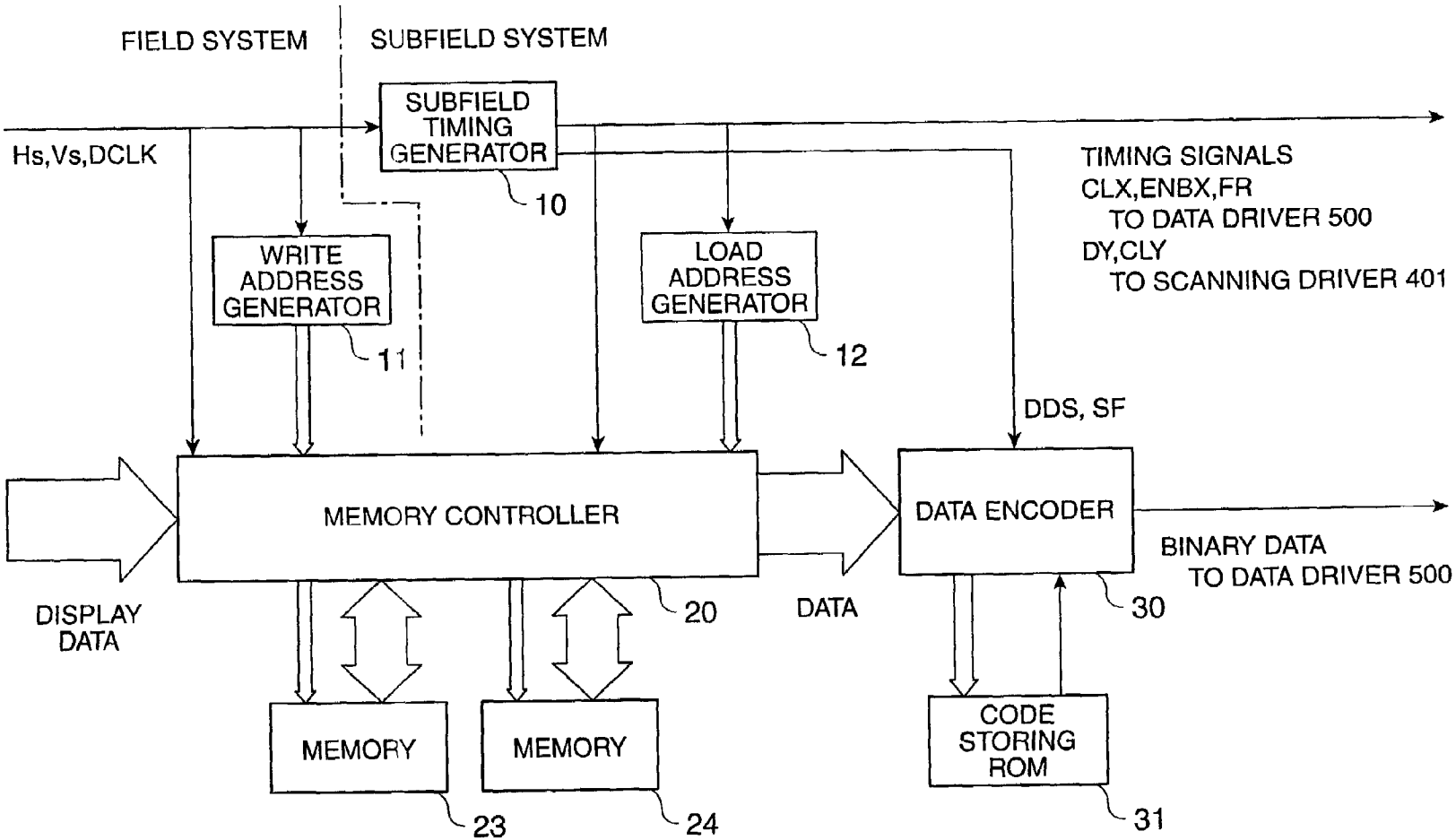
FIG. 23 is a block diagram showing a drive circuit which is adopted in the third embodiment.
Figure 24:
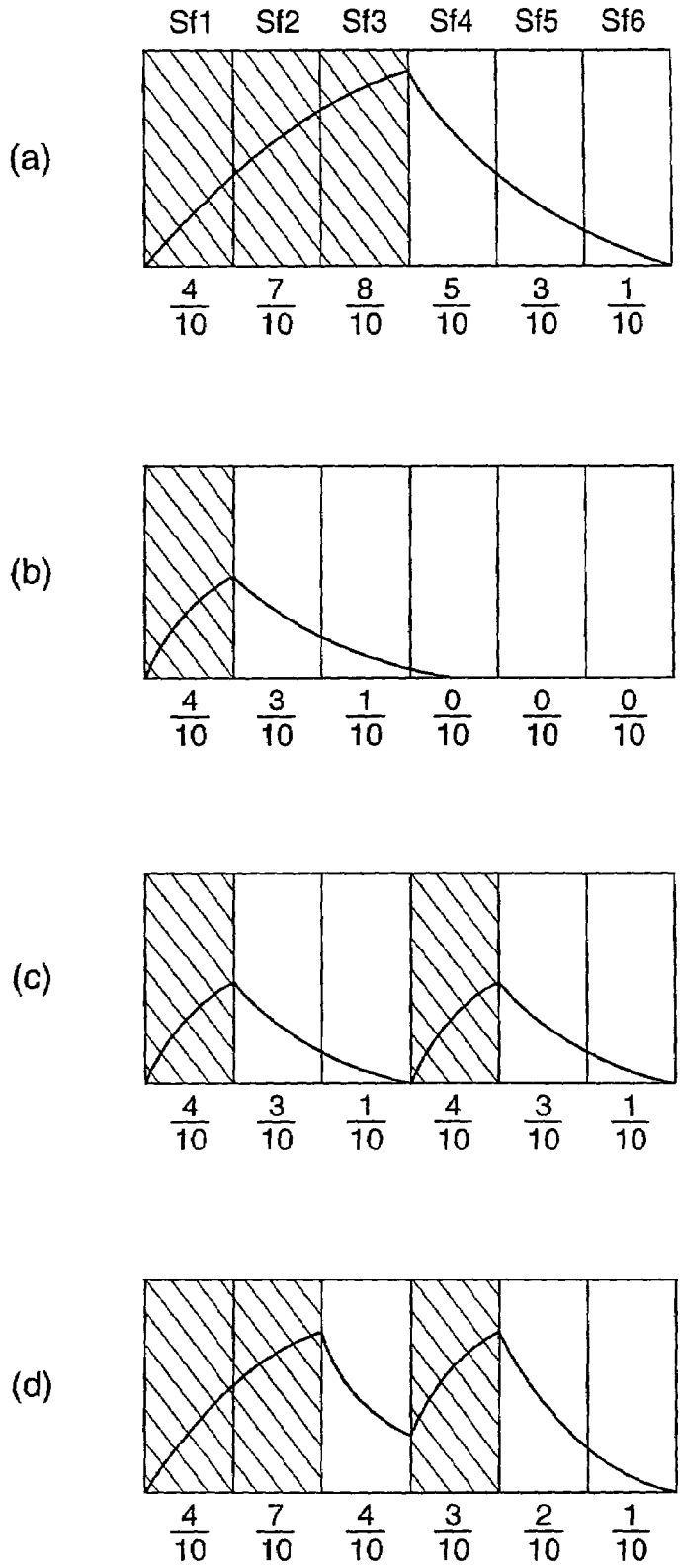
FIG. 24 is an explanatory diagram for explaining the third embodiment.
Figure 25:
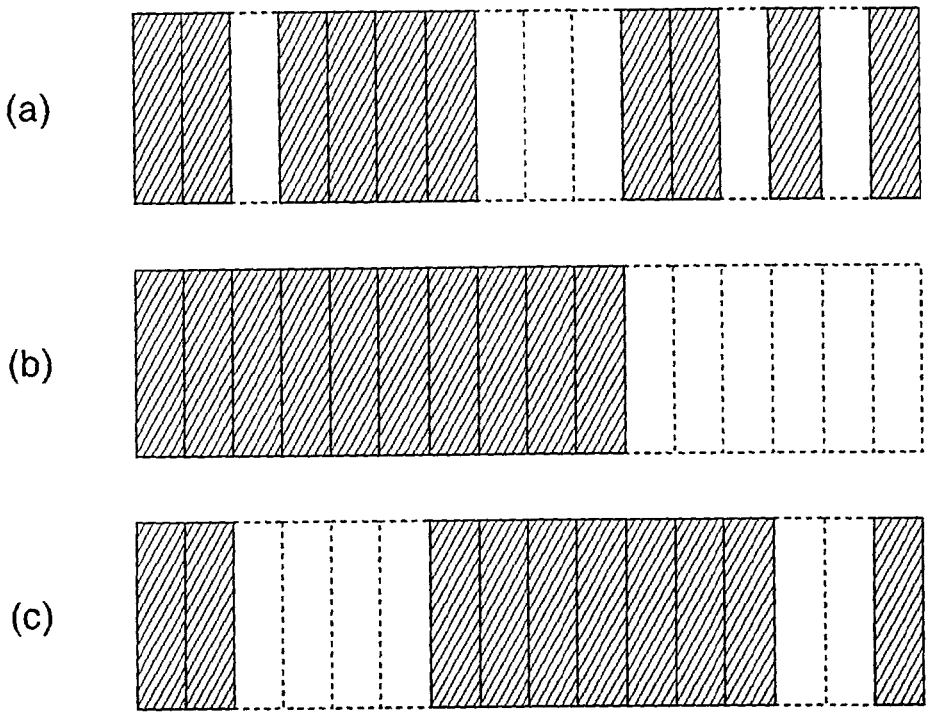
FIG. 25 is an explanatory diagram for explaining the third embodiment.

FIGS. 23 through 25 concern the third embodiment of the present invention. FIG. 23 is a block diagram showing a drive circuit which is adopted in the third embodiment, and FIGS. 24 and 25 are explanatory diagrams for explaining the third embodiment.

A hardware architecture in this embodiment is substantially the same as in the electrooptic device employed in each of the first and second embodiments, but the coding method differs from that of the data conversion circuit 300 in FIG. 1 or the data coding circuit 301 in FIG. 11.

In the first embodiment described before, the subfields in which the ON voltage is applied are concentrated in the first half of the field, whereby the response visibility of the liquid crystal can be bettered, and in the second embodiment, at least one of the subfields is brought to the OFF voltage, whereby the number of displayable gradations can be increased without increasing the number of subfields. However, in a case where the response visibility of the liquid crystal poses no problem as in a still picture, the number of displayable gradations can be more enlarged than in the second embodiment by appropriately setting the positions of the subfields to apply the ON voltage therein and those of the subfields to apply the OFF voltage therein.

Meanwhile, the subfield drive has been adopted in a plasma display, etc. In the plasma display or the like, the length (time width) of each subfield period in one field is changed, thereby to perform weighted subfield drive in which the individual subfields are weighted. The reason therefor is that, in the plasma display or the like, a writing time period (scanning time period) for a pixel is required every subfield period, so enlargement in the number of subfields within one field increases the number of times of the writing scanning for the pixel within one field period, resulting in a shorter luminescing time period and a darker screen ascribable to the writing operations.

In contrast, with the liquid crystal device, a screen does not darken even when the number of subfields in one field is enlarged. As stated before, as the number of subfields in one field is larger, the number of displayable gradations becomes larger. With the liquid crystal device, accordingly, the number of subfields in one field should preferably be enlarged in consideration of gradational expressions. Due to device restrictions on higher speed operations, however, the number of subfields in one field is also subject to limitation.

In this embodiment, therefore, the number of displayable gradations is enlarged without increasing the number of subfields in one field, by utilizing the fact that the saturation response time of the liquid crystal (a time period which is expended in attaining a transmission factor of 100% after the application of the ON voltage to the liquid crystal) is about 5 milliseconds in, for example, projector use.

The drive circuit in FIG. 23 corresponds to, for example, the part of FIG. 11 from which the scanning line drive circuit 401, data line drive circuit 500 and display area 1011*a* have been removed. A horizontal synchronizing signal Hs, a vertical synchronizing signal Vs and a dot clock DCLK are externally applied to a subfield timing generator 10. The subfield timing generator 10 produces timing signals for use in a subfield system, on the basis of the inputted horizontal synchronizing signal Hs, vertical synchronizing signal Vs and dot clock DCLK.

More specifically, the subfield timing generator 10 produces a data transfer clock CLX, a data enable signal ENBX and a polarity inversion signal FR which are display driving signals, and it outputs them to the data line drive circuit 500 (refer to FIG. 11). Besides, the subfield timing generator 10 produces a scanning start pulse DY and a scanning side transfer clock CLY and outputs them to the scanning line drive circuit 401. In addition, the subfield timing generator 10 produces a data transfer start pulse DDS and a subfield identification signal SF for use within a controller, and it outputs them to a data encoder 30.

On the other hand, display data is supplied to a memory controller 20. A write address generator 11 specifies the position on a screen of data being sent on each occasion in accordance with the externally inputted horizontal synchronizing signal Hs, vertical synchronizing signal Vs and dot clock DCLK, and it produces a memory address for storing the display data in memories 23, 24 on the basis of the specified result, so as to output the produced address to the memory controller 20.

A load address generator 12 determines the position on the screen of data to be displayed on each occasion in accordance with the timing signals of the subfield system produced by the subfield timing generator 10, and it produces a memory address for loading the data from the memories 23, 24 on the basis of the determined result and in conformity with the same rules as in the write mode, so as to output the produced address to the memory controller 20.

The memory controller 20 performs controls for writing the inputted display data into the memories 23, 24 and for loading the data to be displayed on the display portion from the memories 23, 24. More specifically, the memory controller 20 writes the externally inputted data into the memories 23, 24 at the address produced by the write address generator 11 and in synchronism with the timing signal DCLK. Besides, it loads the data from the address produced by the load address generator 12, in synchronism with the timing signal CLX produced by the subfield timing generator 10. The memory controller 20 outputs the loaded data to the data encoder 30.

The memories 23, 24 are used while being alternately changed over for writing and for loading every field. The changeover control is performed in conformity with the timing signals by the memory controller 20.

A code storing ROM 31 stores therein binary signals Ds of H level or L level as serve to bring each pixel into an ON state or OFF state every subfield period, in correspondence with the data (gradation data) of the brightness to be displayed of the pixel. The code storing ROM 31 is so constructed that, when supplied with the data (gradation data) to be written into each pixel and a subfield for writing the data thereinto, in terms of an address, it outputs the data (binary signal (data) Ds) of one bit corresponding to the pertinent subfield.

The data encoder 30 produces the address for reading out the necessary data from the code storing ROM 31 in accordance with the data sent from the memory controller 20 and the subfield identification signal SF sent from the subfield timing generator 10, and it reads out the data from the code storing ROM 31 by the use of the produced address, so as to output the read-out data to the data line drive circuit 500 in synchronism with the data transfer clock CLK.

In this embodiment, the binary signals Ds stored in the code storing ROM 31 are set by considering the response characteristic of the liquid crystal, and they have values which are adapted to bring any of all the subfields into a white display or a black display on the basis of the gradation data. FIG. 24 is for explaining the binary signals Ds which are stored in the code storing ROM 31.

FIG. 24 shows an example in which one field is divided into six subfields Sf1–Sf6 on a time base. That is, FIG. 24 corresponds to the example in which one field period is equally divided by six, and in which a pixel is subjected to the subfield drive in each subfield period being each divisional time period. A hatched part in FIG. 24 indicates the subfield period in which an ON voltage is applied, while a non-hatched part indicates the subfield period in which an OFF voltage is applied.

Also in this embodiment, a gradational display is presented for each pixel in such a way that the pertinent pixel is brought into an ON state (white display) or OFF state (black display) in each of the subfield periods Sf1–Sf6 on the basis of designated gradation data.

As shown in FIG. 8, the applied voltage (drive voltage) to the pixel electrode is instantly saturated, whereas the response of the transmission factor of the pixel is slow, and the transmission factor of the liquid crystal is saturated after a predetermined delay time as shown in FIGS. 8 and 13. FIG. 24 exemplifies the use of a liquid crystal material with which a time period of about 3–4 subfield periods is required before the liquid crystal is optically saturated upon applying the ON voltage thereto. Besides, with the liquid crystal material, the non-transmission response time of the liquid-crystal, in which the transmission factor shifts from the saturated state to a non-transmissive state upon applying the OFF voltage to the liquid crystal, is longer than one subfield period.

More specifically, in the example of FIG. 24, the transmission factor of the liquid crystal changes to $4/10$ of the saturation transmission factor in the first subfield period after the application of the ON voltage, it changes to $7/10$ at the end of the next subfield period, namely, in two subfield periods after the application of the ON voltage, it changes to $8/10$ in three subfield periods after the application of the ON voltage, and it changes to $10/10$ in four subfield periods after the application of the ON voltage.

Besides, the example of FIG. 24 is such that the transmission factor of the liquid crystal lowers by $3/10$ in the first subfield period after the application of the OFF voltage, that it lowers by $5/10$ in two subfield periods after the application of the OFF voltage, that it lowers by $7/10$ in three subfield periods after the application of the OFF voltage, and that it lowers by $10/10$ in four subfield periods after the application of the OFF voltage.

FIG. 24(*a*) shows an example in which the ON voltage is applied in the three subfield periods of the first half of one field period, while the OFF voltage is applied in the three subfield periods of the latter half. The transmission factor of the liquid crystal rises up to $4/10$ of the saturation transmission factor in the first subfield period, it rises up to $7/10$ of the saturation transmission factor in the second subfield period, and it rises up to $8/10$ of the saturation transmission factor in the third subfield period. Further, the transmission factor lowers down to $5/10$ of the saturation transmission factor in the fourth subfield period, it lowers down to $3/10$ in the fifth subfield period, and it lowers down to $1/10$ in the sixth subfield period.

As described above, in the case where the cycle of the subfield drive (in the example of FIG. 24, one field period) is sufficiently short, the brightness of the pixel changes in proportion to the integral value of the transmission factor. Assuming that a perfect white display is presented in the case of displaying the pixel at the transmission factor of 100% in all the subfield periods, the brightness in the field period in FIG. 24(*a*) becomes $\{(4+7+8+5+3+1)/10\}\times 1/6=28/60$ of the perfect white display.

Likewise, in the example of FIG. 24(*b*), the brightness of the pixel becomes $\{(4+3+1)/10\}\times 1/6=8/60$ of the perfect white display. Besides, in the example of FIG. 24(*c*), the brightness becomes $\{(4+3+1+4+3+1)/10\}\times 1/6=16/60$ of the perfect white display. Besides, in the example of FIG. 24(*d*), the brightness becomes $\{(4+7+4+3+2+1)/10\}\times 1/6=21/60$ of the perfect white display.

In the case where the subfield periods in which the ON voltage is applied are caused to simply succeed as in the first embodiment, only the displays of 6+1=7 gradations can be attained with the six divisional subfield periods. In contrast, in this embodiment, gradations which are conspicuously larger in number than the 7 gradations can be displayed by appropriately setting the positions of the subfield periods in which the ON voltage is applied, and the positions of the subfield periods in which the OFF voltage is applied.

FIG. 25 shows an example in which, in the third embodiment, one field is divided into 16 subfields on a time base. A hatched part in FIG. 25 indicates the subfield period in which an ON voltage is applied, while a non-hatched part indicates the subfield period in which an OFF voltage is applied. Assuming that a perfect white display is presented in the case of displaying the pixel in white in all the subfield periods, the brightnesses of the pixel in the field periods in FIGS. 25(*a*) through (*c*) become about 60%, 50% and 55% of the perfect white display, respectively.

The example of FIG. 25 signifies that, although the numbers of the subfields in which the ON voltage is applied are equal in all the cases of FIGS. 25(*a*) through 25(*c*), the brightnesses differ in accordance with the array of ON and OFF pulses, in other words, the layout of the positions of the subfield periods for applying the ON voltage therein and the positions of the subfield periods for applying the OFF voltage therein.

Incidentally, although displays of only 17 gradations can be attained with the 16 subfields in the case of the simple succession of the subfield periods in which the ON voltage is applied, gradational expressions of more than 160 gradations are possible in the example of FIG. 25. Likewise, in a case where one field is divided into 32 subfields on a time base, gradational expressions of more than 256 gradations are possible.

By the way, it is the same as in the other embodiments that the dividing number of one field may be any desired number. Besides, this embodiment is also applicable to display devices of low response rate, such as a display device which utilizes electrophoresis.

As thus far described, the present invention brings forth the effects that enhancement in picture quality can be achieved by bettering the response characteristic of a liquid crystal which is an electrooptic material, and that gradations which are much larger in number than subfields can be displayed even in a case where the subfields are determined by simple field division in which weighting is not executed.

The invention claimed is:

1. A drive method of an electrooptic device that divides each field into a plurality of subfields on a time base for driving a pixel, and controls and drives the subfields for bringing into a transmissive state each of a plurality of pixels which include an electrooptic material disposed in intersection areas between a plurality of data lines and a plurality of scanning lines, by an ON voltage or an OFF voltage in accordance with a multi-bit display data, whereby the respective pixels display gradations within one field by a subfield drive scheme, the drive method comprising:

bringing at least one of the subfields in which a pertinent pixel is to be brought into the transmissive state and which are only concentrated in a first half of the pertinent field on the basis of the multi-bit display data, into a non-transmitting condition as controlled for displaying a gradation per pixel on the basis of the multi-bit display data.

2. A drive method of an electrooptic device according to claim 1, among the subfields in which the pertinent pixel is to be brought into the transmissive state and which are only concentrated in the first half of the pertinent field on the basis of the multi-bit display data, at least one subfield other than the subfield where the transmissive state starts, but which lies in the vicinity thereof being brought into the non-transmitting condition in conformity with the rules stipulated by the multi-bit display data.

3. A drive method of an electrooptic device according to claim 1, among the subfields in which the pertinent pixel is to be brought into the transmissive state and which are only concentrated in the first half of the pertinent field on the basis of the multi-bit display data, at least one subfield other than the subfield where the transmissive state ends but which lies in the vicinity thereof being brought into the non-transmitting condition in conformity with rules stipulated by the multi-bit display data.

4. A drive circuit of an electrooptic device having pixels that include pixel electrodes disposed in correspondence with intersections between a plurality of scanning lines and a plurality of data lines, switching elements that control voltages to be applied to the respective pixel electrodes, an electrooptic material enclosed in intersection areas between the plurality of data lines and the plurality of scanning lines, and a counter electrode arranged in opposition to the pixel electrodes;

the drive circuit controlling subfields for bringing each of the pixels into a transmissive state, by an ON voltage or an OFF voltage, whereby the respective pixels display gradations within one field by a subfield drive scheme on the basis of a multi-bit display data;

the drive circuit comprising:

a control device that performs control on the basis of the multi-bit display data so that at least one of the subfields in which a pertinent pixel is to be brought into the transmissive state and which are only concentrated in a first half of the pertinent field on the basis of the multi-bit display data, may be brought into a non-transmitting condition for displaying a gradation per pixel on the basis of the multi-bit display data.

5. An electrooptic device, comprising:

pixels which include pixel electrodes disposed in correspondence with intersections between a plurality of scanning lines and a plurality of data lines, switching elements for controlling voltages to be applied to the respective pixel electrodes, an electrooptic material disposed in intersection areas between the plurality of data lines and the plurality of scanning lines, and a counter electrode arranged in opposition to the pixel electrodes;

a scanning line drive circuit which supplies scanning signals for dividing each field into a plurality of subfields on a time base for driving a pixel, and that renders the switching elements conductive in each of the plurality of subfields, to the scanning lines; and a control device that controls a data line drive circuit in accordance with a multi-bit display data so that pulse signals for bringing the respective pixels into transmissive states are only concentrated in a first half of the field, and that at least one of the pulse signals which bring the pixels into the transmissive states and which are only concentrated in the first half of the field on the basis of the multi-bit display data, may be brought into a non-transmitting condition in accordance with the multi-bit display data for displaying a gradation per pixel.

6. An electronic equipment comprising the electrooptic device according to claim 5.

* * * * *